US007825321B2

(12) United States Patent
Bloom et al.

(10) Patent No.: US 7,825,321 B2
(45) Date of Patent: Nov. 2, 2010

(54) METHODS AND APPARATUS FOR USE IN SOUND MODIFICATION COMPARING TIME ALIGNMENT DATA FROM SAMPLED AUDIO SIGNALS

(75) Inventors: Phillip Jeffrey Bloom, Epson (GB); William John Ellwood, Eastbourne (GB); Jonathan Newland, West Croydon (GB)

(73) Assignee: Synchro Arts Limited, Surrey (GB)

( * ) Notice: Subject to any disclaimer, the term of this patent is extended or adjusted under 35 U.S.C. 154(b) by 1317 days.

(21) Appl. No.: 11/339,873

(22) Filed: Jan. 26, 2006

(65) Prior Publication Data

US 2006/0165240 A1 Jul. 27, 2006

Related U.S. Application Data

(60) Provisional application No. 60/647,555, filed on Jan. 27, 2005.

(51) Int. Cl.
*G10H 1/05* (2006.01)

(52) U.S. Cl. ..... 84/622

(58) Field of Classification Search ..... 84/622
See application file for complete search history.

(56) References Cited

U.S. PATENT DOCUMENTS

| | | | | |
|---|---|---|---|---|
| 4,591,928 | A | 5/1986 | Bloom et al. | 360/13 |
| 5,301,259 | A | 4/1994 | Gibson et al. | 395/2.67 |
| 5,327,521 | A | 7/1994 | Savic et al. | 395/2.81 |
| 5,749,073 | A | 5/1998 | Slaney | 704/278 |
| 5,750,912 | A | 5/1998 | Matsumoto | 84/609 |
| 5,966,687 | A | 10/1999 | Ojard | 704/207 |
| 5,998,725 | A | 12/1999 | Ohta | 84/627 |
| 6,163,614 | A * | 12/2000 | Chen | 381/101 |
| 6,182,042 | B1 | 1/2001 | Peevers | 704/269 |
| 6,336,092 | B1 | 1/2002 | Gibson et al. | 704/268 |
| 6,463,412 | B1 | 10/2002 | Baumgartner et al. | 704/246 |
| 6,629,067 | B1 | 9/2003 | Saito et al. | 704/207 |
| 6,836,761 | B1 | 12/2004 | Kawashima et al. | 704/258 |
| 2004/0054524 | A1 | 3/2004 | Baruch | 704/201 |
| 2007/0140510 | A1 * | 6/2007 | Redmann | 381/97 |

FOREIGN PATENT DOCUMENTS

| | | |
|---|---|---|
| GB | 2 290 685 A | 1/1996 |
| JP | 2003-36085 | 2/2003 |
| JP | 2003-44066 | 2/2003 |
| JP | 2003-345400 | 12/2003 |
| WO | WO 94/22130 | 9/1994 |
| WO | WO 98/55991 | 12/1998 |

* cited by examiner

OTHER PUBLICATIONS

D.T. Chappell et al., "Speaker-Specific Pitch Contour Modeling and Modification," *Acoustics, Speech and Signal Processing—Proceedings of the 1998 IEEE International Conference on Seattle, WA*, vol. 2, May 12-15, 1998, pp. 885-888.

*Primary Examiner*—Jeffrey Donels
(74) *Attorney, Agent, or Firm*—Fredrikson & Byron, P.A.

(57) ABSTRACT

A digitised audio signal, such as an amateur's singing, and a digital guide audio signal are supplied to a time alignment process that produces a time-aligned new signal, time-aligned to the guide signal. Pitch along the time-aligned new signal and along the guide signal is measured in processes and which supply these measurement to a pitch adjustment calculator which calculates a pitch correction factor C's(Fps) from these measurements and the nearest octave ratio of the signals. A pitch changing process modulates the pitch of the time-aligned new signal to produce a time-aligned and pitch adjusted new signal.

51 Claims, 12 Drawing Sheets

Mapping Window ts(v) to Closest ta(u) Window in Time

METHODS AND APPARATUS FOR USE IN SOUND MODIFICATION COMPARING TIME ALIGNMENT DATA FROM SAMPLED AUDIO SIGNALS

PRIORITY CLAIM

The present application claims priority to U.S. Provisional Patent Application Ser. No. 60/647,555, filed Jan. 27, 2005, which is incorporated in this document by reference.

TECHNICAL FIELD

The present invention relates to signal modification. More specifically, but not exclusively, the invention relates to problems that arise in modifying one digitised sound signal based on features in another digitised sound signal, where corresponding features of the first and second sound signals do not occur at the same relative positions in time within the respective signals.

BACKGROUND OF THE INVENTION

It is well known to be difficult to speak or sing along with an audio or audio/video clip such that the new performance is a precisely synchronised repetition of the original actor's or singer's words. Consequently, a recording of the new performance is very unlikely to have its start and detailed acoustic properties synchronized with those of the original audio track. Similarly, features such as the pitch of a new singer may not be as accurate or intricately varied as those of the original singer. There are many instances in the professional audio recording industry and in consumer computer-based games and activities where a sound recording is made of a voice and the musical pitch of the newly recorded voice would benefit from pitch adjustment, generally meaning correction, to put it in tune with an original voice recording. In addition, a recording of a normal amateur singing, even if in tune, will not have the skilful vocal style and pitch inflections of a professional singer.

FIG. 4 displays pitch measurements of a professional singer (Guide Pitch 401) and a member of the public (New Pitch 402) singing of the same words to the same musical track. The timing discrepancies between the onsets and offsets of corresponding sections (pulses) of voiced signals (non-zero Hz pitch values) as well as positions of unvoiced or silent sections (at zero Hz) are frequent and significant. Applying pitch data from the Guide Pitch 401 directly at the same relative times to the data of the New Pitch 402 would clearly be wrong and inappropriate for a substantial amount of the segment shown. This is a typical result and illustrates the basic problems to be solved.

Musical note-by-note pitch adjustment can be applied automatically to recorded or live singing by commercially available hardware and software devices, which generally tune incoming notes to specified fixed grids of acceptable note pitches. In such systems, each output note can be corrected automatically, but this approach can often lead to unacceptable or displeasing results because it can remove natural and desirable "human" variations.

The fundamental basis for target pitch identification in such known software and hardware devices is a musical scale, which is basically a list of those specific notes' frequencies to which the device should first compare the input signal. Most devices come with preset musical scales for standard scales and allow customisation of these, for example to change the target pitches or to leave certain pitched notes unaltered.

The known software devices can be set to an automatic mode, which is also generally how the hardware devices work: the device detects the input pitch, identifies the closest scale note in a user-specified preset scale, and changes the input signal such that the output pitch matches the pitch of the specified scale's note. The rate at which the output pitch is slewed and retuned to the target pitch, sometimes described as "speed", is controlled to help maintain natural pitch contours (i.e. pitch as a function of time) more accurately and naturally and allow a wider variety of "styles".

However, the recorded singing of an amateur cannot be enhanced by such known automatic adjustment techniques to achieve the complex and skilled pitch variations found in the performance of a professional singer.

There are also known voice processing methods and systems which perform pitch correction and/or other vocal modifications by using target voices or other stored sequences of target voice parameter data to specify the desired modifications. These known methods have one or more significant shortcomings. For example:

1. The target pitch (or other vocal feature) that is being applied to the user's input voice signal rigidly follows the timing of a Karaoke track or other such accompaniment that the user sings to—generally in real time—and no attempt is made to align corresponding vocal features (U.S. Pat. No. 5,966,687, Japanese patent 2003044066). If the user's voice starts too early relative to the timing of the target feature (e.g. pitch) data, then the target feature will be applied, wrongly, to later words or syllables. A similar problem arises if the user's voice is late. Within phrases, any words or syllables that are out of time with the music track will be assigned the wrong pitch or other feature for that word or syllable. Similarly, any voiced segments that occur when unvoiced segments are expected receive no stored target pitch or other target feature information.
2. The target pitch (or other vocal feature) being applied to the user's input voice relies on and follows the detection of an expected stored sequence of input phonemes or similarly voiced/unvoiced patterns or just vowels (e.g. U.S. Pat. No. 5,750,912). Such methods generally require user training or inputting of fixed characteristics of phoneme data and/or require a sufficiently close pronunciation of the same words for accurate identification to occur. If there is no training and the user's phoneme set differs sufficiently from the stored set to not be recognized, the system will not function properly. If user's phonemes are not held long enough, or are too short, the output notes can be truncated or cut off. If phonemes arrive too early or too late, the pitch or feature might be applied to the right phoneme, but it will be out of time with the musical accompaniment. If the user utters the wrong phoneme(s), the system can easily fail to maintain matches. Moreover, in a song, a single phoneme will often be given a range of multiple and/or a continuum of pitches on which a phonemic based system would be unlikely to implement the correct pitch or feature changes. Accurate phoneme recognition also requires a non-zero processing time—which could delay the application of the correct features in a real-time system. Non-vocal sounds (e.g. a flute) cannot be used as guide signals or inputs.
3. The target pitch model is based on a set of discrete notes described typically by tables (e.g. as Midi data), which is generally quantized in both pitch and time. In this case, the modifications to the input voice are limited to the stored notes. This approach leads to a restricted set of available vocal patterns that can be generated. Inter-note transitions, vibrato and glissando control would be generally limited to coarse note-based descriptors (i.e. Midi). Also, the processed pitch-corrected singing voice can take on a mechanical (monotonic) sound, and if the pitch is applied to the wrong part of a word by mistiming, then the song will sound oddly sung and possibly out of tune as well.

4. The system is designed to work in near real-time (as in a live Karaoke system) and create an output shortly (i.e. within a fraction of a second) after the input (to be corrected) has been received. Those that use phoneme or similar features (e.g. U.S. Pat. No. 5,750,912) are restricted to a very localized time slot. Such systems can get out of step, leading for example, to the Karaoke singer's vowels being matched to the wrong part of the guiding target singing.

SUMMARY OF INVENTION

There exists, therefore, the need for a method and apparatus that firstly establish a detailed timing relationship between the time-varying features of a new vocal performance and corresponding features of a guiding vocal performance. Secondly, this timing alignment path must be used as a time map to determine and apply the feature (e.g. pitch) adjustments correctly to the new vocal performance at precisely the right times. When done correctly, this permits nuances and complexity found in the guiding vocal performance (e.g. for pitch: vibrato, inflection curves, glides, jumps, etc.) to be imposed on the new vocal performance. Furthermore, if time alignment is applied, other features in addition to or as an alternative to pitch can be controlled; for example glottal characteristics (e.g. breathy or raspy voice), vocal tract resonances, EQ, and others.

Another objective of this invention is to provide methods for vocal modifications that operate under non-ideal input signal conditions, especially where the new input (e.g. user voice): (a) is band-limited and/or limited in dynamic range (for example input via a telephone system); (b) contains certain types of noise or distortion; or (c) is from a person with a different accent, sex, or age from the guiding (target) voice, or with very different timing of delivery of words and phonemes whether they are the same or different from the guiding (target) signal and even with different input languages.

A further objective is to provide a method that does not require any prior information on either signal to be stored e.g. regarding the phonemic nature of the signals, or the detailed set of possible signal states that could be applied to the output signal. Thus a related further objective is to provide a method that can operate with a guiding audio signal and a new audio signal, either or both of which are not required to be speech or singing.

There already exist systems and methods for time mapping and alignment of audio signals. A method and apparatus for determining time differences between two audio signals and automatically time-aligning one of the audio signals to the other by automatic waveform editing has been described in GB patent 2117168 and U.S. Pat. No. 4,591,928 (Bloom et. al.). Other techniques for time alignment are described in J Holmes and W Holmes, (2001), "Speech synthesis and recognition, 2nd Edition", Taylor and Francis, London.

Techniques for pitch changing and other vocal modifications are also well established, one example being K. Lent (1989), "An efficient method for pitch shifting digitally sampled sounds," Computer Music Journal Vol. 13, No. 4, at pages 65 to 71.

The invention is defined by the claims hereinafter, reference to which should now be made.

Preferred embodiments of this invention provide methods and apparatus for automatically and correctly modifying one or more signal characteristics of a second digitized audio signal to be a function of specified features in a first digitized audio signal. In these embodiments, the relative timing relationships of specified features in both signals are first established. Based on these timing relationships, detailed and time-critical modifications of the signal's features can be applied correctly. To achieve this, a time-alignment function is generated to create a mapping between features of the first signal and features of the second signal and provide a function for optionally editing the second (user's) signal.

Particular applications of this invention include accurately transferring selected audio characteristics of a professional performer's digitized vocal performance to—and thereby enhancing—the digitized audio performance of a less skilled person. One specific application of this invention is that of automatically adjusting the pitch of a new audio signal ("New Signal") generated by a typical member of the public to follow the pitch of another audio signal ("Guide Signal") generated by a professional singer. An example of this is a karaoke-style recording and playback system using digitized music videos as the original source in which, during a playback of the original audio and optional corresponding video, the user's voice is digitized and input to the apparatus (as the New recording). With this system, a modified user's voice signal can be created that is automatically time and pitch corrected. When the modified voice signal is played back synchronously with the original video, the user's voice can accurately replace the original performer's recorded voice in terms of both pitch and time, including any lip synching. During playback of the music video, the impact of this replacement will be even more effective if the original, replaced voice signal is not audible during the playback with the user's modified voice recording. The modified voice recording can be combined with the original backing music as described in WO 2004/040576.

An additional application of this invention is in the creation of a personalized sound file for use in telephone systems. In such applications, the user sings or even speaks to provide a voice signal that is recorded and then enhanced (for example pitch and time corrected to follow the characteristics of a professional singer's version) and optionally mixed with an appropriate backing track. The resulting enhanced user recording can then be made available to phone users as a personalized ringtone or sound file for other purposes. Apparatus embodying the invention may then take the form of, for example, a server computer coupled into a telecommunications system comprising a telecommunications network and/or the Internet, and may utilise mobile phone as an interface between the apparatus and users. Additionally or alternatively, a mobile phone may be adapted to embody the invention. In such a system, a modified voice signal, or data representing such a signal, produced by an embodiment of the invention may be transmitted to a selected recipient through a ringtone delivery system to be used as a ring tone or other identifying sound signal.

In preferred embodiments of the present invention, the inclusion of the step of creating a time-dependent mapping function between the Guide and New Signals ensures that the signal feature modifications are made at the appropriate times within the New Signal regardless of substantial differences between the two signals. The time alignment function is used to map the control feature function data to the desired signal modification process. The modification process accesses a New Signal and modifies it as required. This action creates a new third audio signal from the New Signal. Accordingly, the third signal then has the desired time varying features determined by the features specified as control features of the Guide Signal.

In one embodiment, a second audio signal, the New Signal, is time-modified (non-linearly time compressed or expanded) using the mapping information from the time alignment function so that its time-varying features align in time with a first audio signal, the Guide Signal. This time alignment can take place before or after the desired modifications described above have taken place.

In an alternative embodiment, the time alignment process is not performed on the new or modified waveform. Instead the time-warping path is used to map the control features of the first signal (Guide Signal audio control parameters) to the second signal in order to modify the appropriate parts of the second signal's waveform and keep its original timing.

By carrying out processing without the constraint of real-time processing, detailed analysis of stored versions of the Guide and New Signals can be performed, and a statistically significant and substantial amount of both signals (say as much as up to 30 seconds or even the entire signals) processed before the time alignment process begins and critical decisions are made regarding long term signal characteristics.

Accordingly, large-scale time discrepancies (e.g. of several seconds) can be accommodated and corrected and localized optimal alignment can take place within words and phrases. Moreover, feature modifications are also done "off-line" allowing the highest quality processing to be applied as well as an interpolation and/or smoothing of the modification-related data to remove any apparent gross errors before application to the New Signal.

Sets of output feature values for the New Signal do not have to be pre-defined. For example if the pitch of a New Signal provided by a user is to be corrected to match the pitch of a Guide Signal in the form of a recording of a professional singer, the acceptable pitch values do not need to be defined or set. Instead, the user's voice will be adjusted to the values that are present and measured in the Guide Signal recording.

The New Signal does not have to be restricted to resemble the Guide Signal or be generated by the same type of acoustic processes as the Guide Signal. For example, monotonic speech could be time and pitch modified to follow a solo woodwind instrument or a bird chirping. As long as both signals have some time-varying features that can be treated as related, a method embodying the invention can create an output signal with appropriately modified properties. Furthermore, features of the New Signal and the Guide Signal may be offset in frequencies from one another. For example, the pitch of one signal may be an octave or more apart from the other signal.

It should also be noted that one or both audio signals may be in the ultra sound or infra sound regions.

By operation of a preferred embodiment of the present invention the complex and skilled pitch variations (and, optionally other characteristics) found in the performance of a professional singer can be accurately transferred to the digitized voice of a user (e.g. amateur) singer. This enhances many aspects of the user's performance to the professional's level.

Embodiments of the invention can also be applied in the field of Automatic Dialogue Replacement (ADR) to enhance an actor's ADR studio-recorded performance. An embodiment can be used to modify the studio-recording's vocal characteristics such as pitch, energy level and prosodic features to match or follow those of the original Guide Signal recorded on set or location with the image. Moreover, the actor in the studio can be a different actor from the one who recorded the Guide Signal.

In addition, the invention is flexible in the range of processes that can be applied. For example, in the case of pitch adjusting, further pitch changing functions, such as time-aligned harmony generation, can be introduced as functions of the pitch adjustment function to create alternative output signals. Additionally, one measured feature in the Guide Signal can be mapped by an arbitrary function to control another entirely different feature in the New Signal.

Methods embodying this invention can be implemented with computer programs in a computer system such as a PC or computer-based games console with means for audio input and output.

There are many permutations of the arrangements of processing sequences that can be implemented, some having advantages over others in certain situations. Examples below are given with regard to processing pitch to illustrate how the variations affect processing complexity and/or reduce the potential for generating audible signal artefacts in the output signal. Similar observations and results would arise in considering processing features other than pitch, such as loudness, tone or formant structure.

Typically, in an embodiment, to start, the New and Guide Signals are sampled and stored digitally. Next, a robust, speaker-independent short time feature analysis extracts the profiles of feature modulations in both signals. Spectral energy measurements are made every 10 ms over successive windowed "frames" of the signals, with noise and level compensation algorithms provided (for example as described in U.S. Pat. No. 4,591,928). This analysis is performed over the entire input signal to maximise the accuracy and robustness of the processing. Other short-term feature measurements can alternatively be used, examples of which can be found in L. R. Rabiner and R. W. Schafer (1978) "Digital Processing of Speech Signals," Prentice Hall.

Taking the example of pitch determination, the remaining main signal processing steps to be performed in the computer system on the recorded signals and their measured signal feature data are:—

Method 1

(a) The Guide Signal's and New Signal's time-dependant feature sequences are processed in a pattern-matching algorithm that determines and outputs an optimal Time Alignment path function as a data sequence. This path optimally maps frames of the New Signal to frames of the Guide Signal.

(b) The data from the Time Alignment path is used to edit the New Signal and generate a New Signal that is time-aligned to the Guide Signal.

(c) The Guide Signal is segmented into discrete consecutive frames and the pitch of each frame is measured. The pitch measurement sequence values are smoothed to provide the Guide Signal pitch contour.

(d) The processing in Step (c) is repeated for the aligned (edited) New Signal to generate its pitch contour.

(e) Each pitch contour value of the Guide Signal is divided by the corresponding pitch contour value for the aligned New Signal and adjusted for octave shifts to generate a correction contour that is a set of values giving the correction factor to apply to each frame of the aligned New Signal. This correction contour is smoothed to remove any gross errors.

(f) A pitch-shifting algorithm is used to shift the pitch of the aligned New Signal to values according to the smoothed correction contour from step (e) and thereby generate a New Signal matching in time and pitch to the given Guide Signal.

Method 1 employs two editing algorithms in cascade and measures the pitch of the New Signal after it has undergone one step of editing. Thus, the quality of the generated output in Method 1 is dependent on the output quality of the edited signal from step (b). Consequently imperfections introduced during editing in that signal can degrade the quality of outputs of steps (d) and (f). This could lead to occasional small errors in the corrected pitch and possibly create a subtle roughness in the generated output.

Method 2

To reduce the risk of such errors, another embodiment combines above steps (b) and (f) to form a single editing stage. Also any characteristic of the New Signal (in this example, pitch) is measured from the unmodified New Signal, and not from a time-aligned (edited) version. This is achieved by calculating the inverse of the time alignment path. The inverse path maps each frame of the unedited New Signal to its corresponding frame of the Guide Signal. From this mapping a pitch correction contour for the New Signal is calculated that is aligned in time to the Guide Signal. In effect the Guide Signal is being aligned in time to the New Signal before the pitch correction contour is calculated.

The following steps summarize this method.

(a) The Guide Signal and New Signal's time-dependant feature sequences are processed in a pattern-matching algorithm that determines and outputs an optimal Time Alignment path function as a data sequence which optimally maps New Signal frames to frames of the Guide Signal.

(b) The data from the Time Alignment path is used to produce an inverse path function mapping the frames of the Guide Signal to the corresponding frames of the New Signal.

(c) The Guide Signal is segmented into discrete frames and the pitch of each frame is measured. The pitch measurement sequence values are smoothed to provide the Guide Signal pitch contour.

(d) The processing in Step (c) is repeated for the New Signal (unedited) to generate its pitch contour.

(e) Using the inverse path function to align the Guide Signal pitch contour to the New Signal pitch contour, each pitch contour value of the mapped Guide Signal is divided by the corresponding pitch contour value for the New Signal and adjusted for octave shifts to generate an aligned correction contour that is a set of values giving the correction factor to apply to each frame of the New Signal. This aligned correction contour is smoothed to remove any gross errors.

(f) Using both the Time Alignment path function and the smoothed aligned correction contour, the New Signal is edited using a processing algorithm that both shifts its pitch and time-compresses or time-expands the New Signal as required to generate an output signal that is aligned in time and in pitch to the Guide Signal.

(g) Or, as an alternative to step (f), the smoothed aligned correction contour could be applied without the time alignment of the New Signal to the Guide Signal. This would keep the original timing of the New Signal but would apply the pitch correction to the correct frames of the New Signal, even though the New Signal has not been aligned in time to the Guide Signal.

Either form of Method 2 provides a more reliable and natural sounding pitch correction over all words and phrases, which can follow and recreate faithfully any subtle nuances such as vibrato and other details.

Method 3

Although Method 2 only edits the New Signal once, it utilises a processing technique that modifies the pitch and time alignment at the same time. By varying the sequence of steps slightly it is possible to separately process the pitch shifting and time modification without using Method 1. Although this introduces two stages of editing, the most appropriate specialised processing algorithms can be chosen separately for each stage.

The following steps summarize this third method:

(a) The Guide Signal's and the New Signal's time-dependant feature sequences are processed in a pattern-matching algorithm that determines and outputs an optimal Time Alignment path function as a data sequence which optimally maps New Signal frames to frames of the Guide Signal.

(b) The Guide Signal is segmented into discrete frames and the pitch of each frame is measured. The pitch measurement sequence values are smoothed to provide the Guide Signal pitch contour.

(c) The processing in Step (b) is repeated for the New Signal (unedited) to generate its pitch contour.

(d) Using the time-alignment Path function, the New Signal's pitch contour is effectively time-aligned to the Guide Signal pitch contour.

(e) Each Guide Signal pitch contour value is divided by the corresponding time-aligned New Signal's pitch contour value, and the result is adjusted for octave shifts. This generates an aligned correction contour containing the correction factors to apply to each frame of a time-aligned New Signal. This aligned correction contour is smoothed to remove any gross errors.

(f) The data from the Time Alignment path is used to edit the New Signal and generate a New Signal that is time-aligned to the Guide Signal.

(g) Using a pitch-shifting algorithm, the pitch of the time-aligned New Signal is shifted by the smoothed aligned correction contour generated in step (e). This gives an edited New Signal aligned in time and in pitch to the given Guide Signal Method 3 uses the original time alignment path function and not the inverse. Moreover, it has the advantage as in Method 2 that the pitch of the unmodified New Signal is measured and not that of a time-aligned (edited) version. However, it cannot modify the pitch of the New Signal (step g) without first generating a time-aligned version (step f).

In further embodiments, other features of a sound signal besides pitch can be modified to follow those in a Guide Signal, once a time alignment function has been created. The additional types of time-synchronous modifiable features include the modification of sound signal features such as instantaneous loudness, equalization, speech formant or resonant patterns, reverberation and echo characteristics, and even words themselves, given a suitable mechanism for analysis and modification of the specified feature is available.

In the present invention, a video signal is not necessary, and the input audio signal may be required to only accompany or replace another audio signal.

In a preferred embodiment of the invention, a means is included for determining a time alignment function or time warping path, that can provide an optimal and sufficiently detailed time mapping between the time varying features of a second (New) audio signal corresponding with time-varying features in a first (Guide) audio signal. This mapping ensures that the time-varying alterations are based on the specified features in the portion of the Guide (control) signal that corresponds to the appropriate portion of the New Signal being modified. Measurements of specific time-varying features used for determining the time alignment are made every T seconds, on short portions or windows of the sampled signal's waveforms, each window being of duration T', and T' may be different from T. Measurements are made on a successive frame-by-frame basis, usually with the sampling windows overlapping. This is "short-time" signal analysis, as described in L. R. Rabiner and R. W. Schafer (1978) "Digital Processing of Speech Signals," Prentice Hall.

It should be noted that the features measured for the time alignment process are likely to be features different from both the features being altered and the features used as a control. A functional relationship between the features to be altered and the control feature parameters must be defined. For example, one simple relationship described in more detail hereinafter, modifies the pitch of a New Signal to match that of a Guide Signal, with adjustments to maintain the natural pitch range of a person who creates the New Signal. This definition of the modification function, and other definitions, can additionally be varied with time if desired. The modification function can be programmed as a data array of output values vs. input values, or as a mathematical function or as a set of processing rules in the audio processing computer system. Note that this function is not necessarily dependent on the signal itself and so the signal may not need any analysis. In further steps, the feature specified to be modified in the second signal and the specified control feature in the first signal are both measured as functions of time. These measurements are stored as data.

BRIEF DESCRIPTION OF THE DRAWINGS

FIG. 10 (*b*) is a graphic representation of an example of the relative positions and shapes of the synthesis windows used to create a signal s"(n) using overlap and add synthesis.

DETAILED DESCRIPTION OF THE INVENTION

Computer systems capable of recording sound input whilst simultaneously playing back sound and/or video signals from digitized computer video and audio files are well known. The components of a typical PC system and environment that can-support these functions are presented in FIG. 1 of the accompanying drawings and this system can be used with the software in FIG. 2 as the basis of providing the hardware and software environment for multiple embodiments of this present invention.

Figure 1:
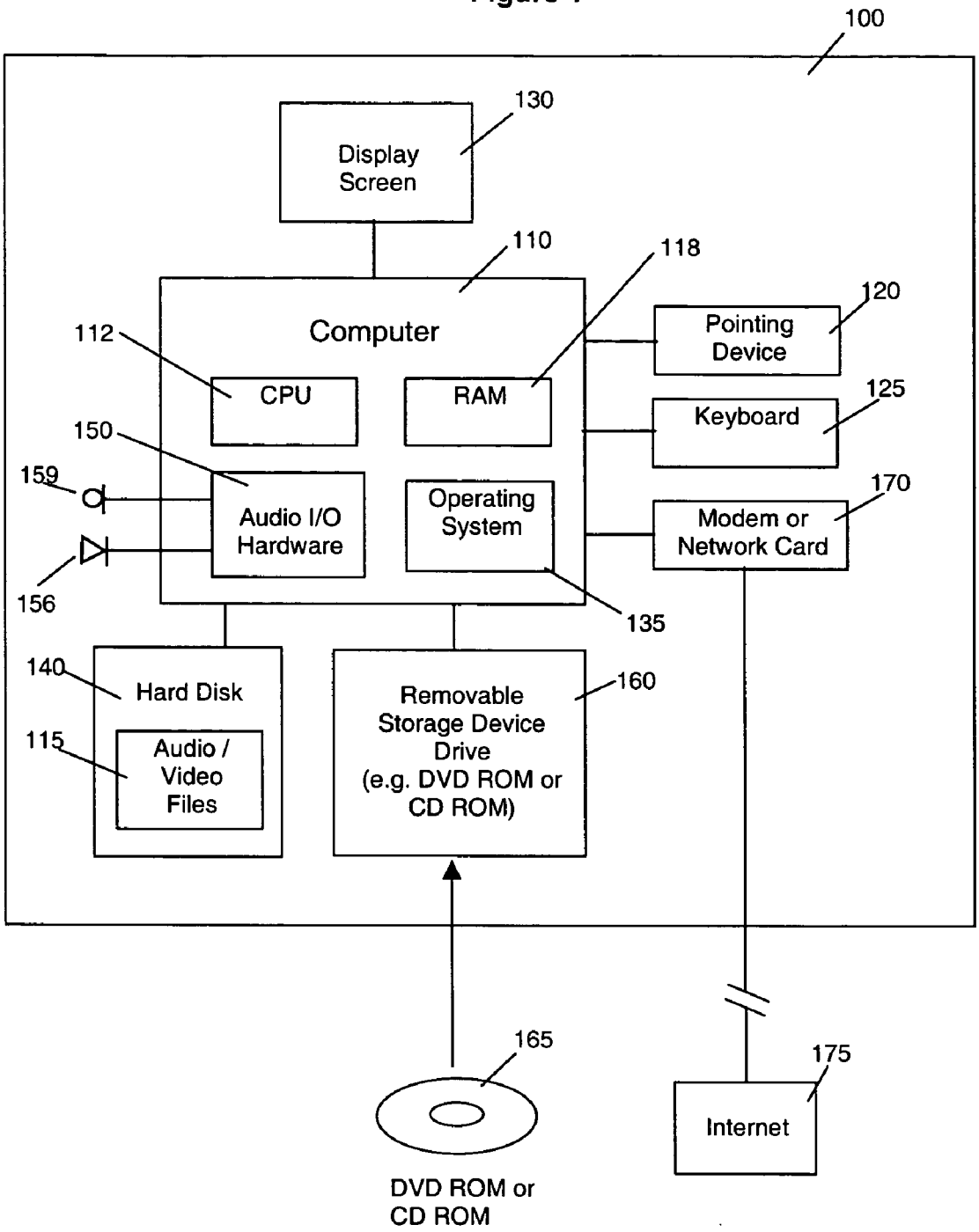
FIG. 1 is a block diagram of a computer system suitable for use in implementing the present invention.

In FIG. 1 a conventional computer system 100 is shown which consists of a computer 110 with a CPU (Central Processing Unit) 112, RAM (Random Access Memory) 118, user interface hardware typically including a pointing device 120 such as a mouse, a keyboard 125, and a display screen 130, an internal storage device 140 such as a hard disk or further RAM, a device 160 for accessing data on fixed or removable storage media 165 such as a CD ROM or DVD ROM, and optionally a modem or network interface 170 to provide access to the Internet 175. The pointing device 120 controls the position of a displayed screen cursor (not shown) and the selection of functions displayed on the screen 130.

Figure 2:
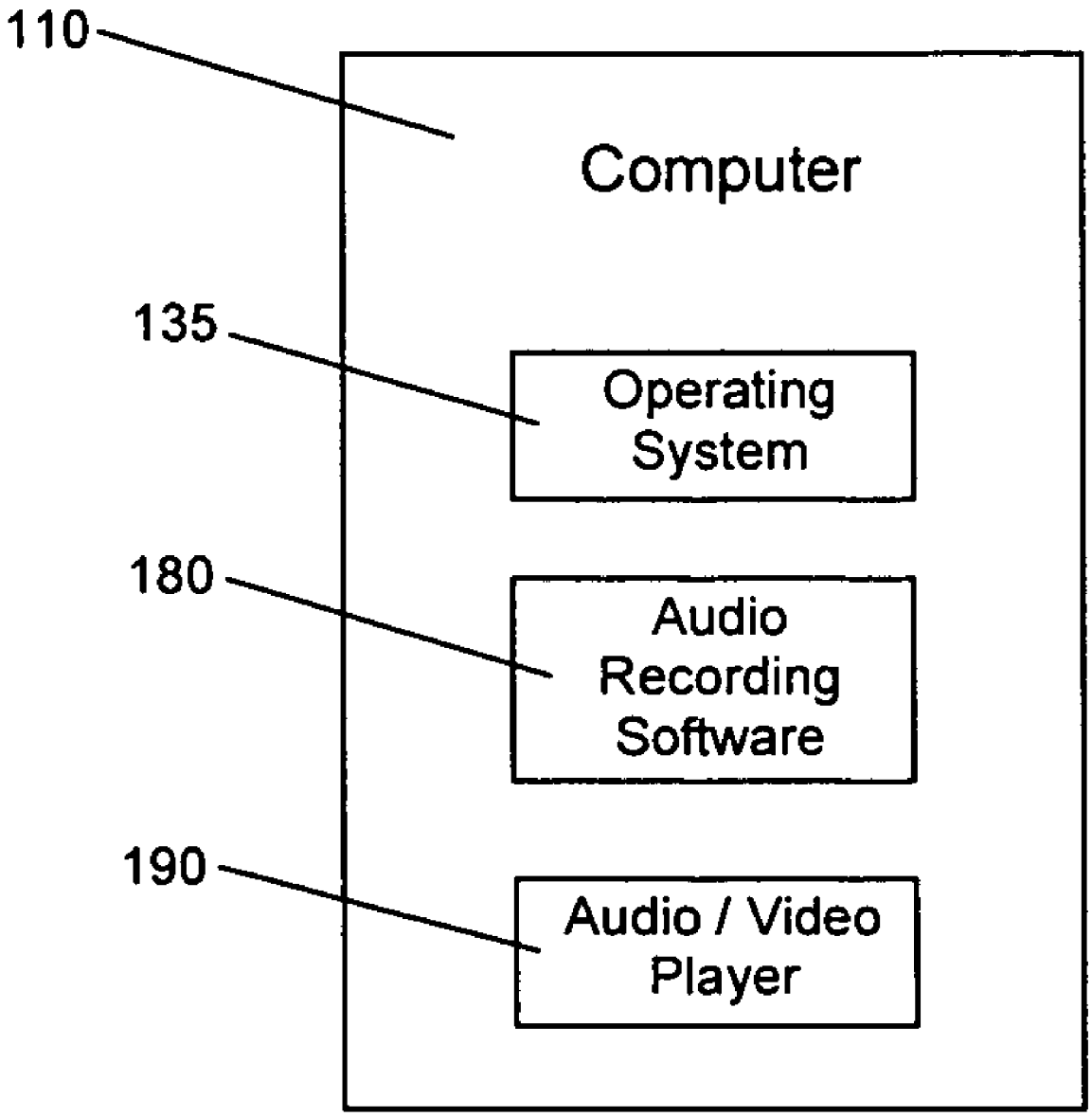
FIG. 2 is a block diagram showing additional software components that can be added to the computer in FIG. 1 to implement the present invention.

The computer 110 may be any conventional home or business computer such as a PC or Apple Macintosh, or alternatively a dedicated "games machine" such as a Microsoft® Xbox™ or Sony Playstation 2™ with the pointing device 120 then being a game controller device. Some components shown in FIG. 1 may be absent from a particular games machine. FIG. 2 illustrates further software that may be installed in the computer 110.

A user may obtain from a CD ROM, the Internet, or other means, a digital data file 115 containing an audio and optional accompanying video clip which, for example, could be in a common format such as the avi or QuickTime® movie format and which is, for example, copied and stored on the hard disk 140 or into RAM. The computer 110 has a known operating system 135 such as that provided by any of the available versions of Microsoft® Windows® or Mac® OS, audio software and hardware in the form of a sound card 150 or equivalent hardware on the computer's mother board, containing an ADC (Analogue to Digital Converter) to which is connected a microphone 159 for recording and containing a DAC (Digital to Analogue Converter) to which is connected one or more loudspeakers 156 for playing back audio.

As illustrated in FIG. 2, such an operating system 135 generally is shipped with audio recording and editing software 180 that supports audio recording via the sound card 150 and editing functions, such as the "Sound Recorder" application program shipped with Windows®. The recording program and/or other programs can use sound card 150 to convert an incoming analogue audio signal into digital audio data and record that data in a computer file on the hard disk drive 140. Audio/video player software 190, such as Windows Media Player shipped with Windows® and/or other software can be used for playing composite digital video and audio files or just audio files through the sound card 150, further built-in video hardware and software, the display screen 130 and the speakers 156. Composite video and audio files consist of video data and one or more parallel synchronized tracks of audio data. Alternatively, audio data may be held as separate files allocated to store multiple streams of audio data. The audio data may be voice data such as dialogue or singing, instrumental music, "sound effects", or any combination of these. Blocks 180 and 190 can also, in concert with 135 and 110, represent the software and hardware that can implement the signal processing systems that will be described herein.

Alternative distributed embodiments of the hardware and software system in 100 and 110 can be employed, one example being where the main elements of computer system 100 are provided to the user by a remote server. In such a case, the input and output transducers 159 and 156 could be provided at the user's end by telephones or microphones and speakers connected to the user's PC system, with analogue or digitised audio signals transmitted between the user and 100 via a telephone system network and/or the Internet. The user can remotely control the system operation by numerous methods including a telephone touchtone keypad, a computer keyboard, voice input, or other means.

An embodiment of this invention in the form of a non-real time consumer Karaoke system allows a member of the public record their voice singing a pop song to a music video in a computer based-system. When the user's recorded voice is modified and then subsequently played back, the modified voice is both lip-synchronized to the original singer's mouth movements and has the same pitch variation as the replaced singer's voice in the music video. The system of FIG. 2 allows the audio playback of the original performer singing a song with or without an accompanying video. The user can play back the song and the system will digitize and record (store) the user's voice onto the computer's hard disk or other memory device. As there is a requirement to measure accurately features of the original singer's voice, it is better to have that voice signal separate from the backing music track. This can most effectively be achieved by requesting an isolated recording of the voice from the record company or organization providing the media content.

In the present embodiment a first signal, the Guide Signal, is used which is a digitized recording of the singer performing a song in isolation (e.g. the solo vocal track transferred from a multi-track recording from the original recording session), preferably without added processing such as echo or reverberation. Such digitized Guide Signals, g(n), can be provided to the user's system on CD or DVD/ROM 165 or via the Internet 175. Alternatively, in further embodiments, the required features of a Guide Signal (for both time alignment and for feature modification control) can be pre-analysed in the same or another system to extract the required data. This data can be input to the system 100 for use as data files via 165, 175 or via other data transfer methods. Data stores and processing modules of the embodiment are shown in FIG. 3.

The user, running the sound recording and playback program, plays the desired song with the original singer audible or not audible and sings at the same time. The user's singing is digitized and recorded into a data file in a data store 310. This digitized signal is the second signal, i.e. the New Signal, s(n).

Figure 3:
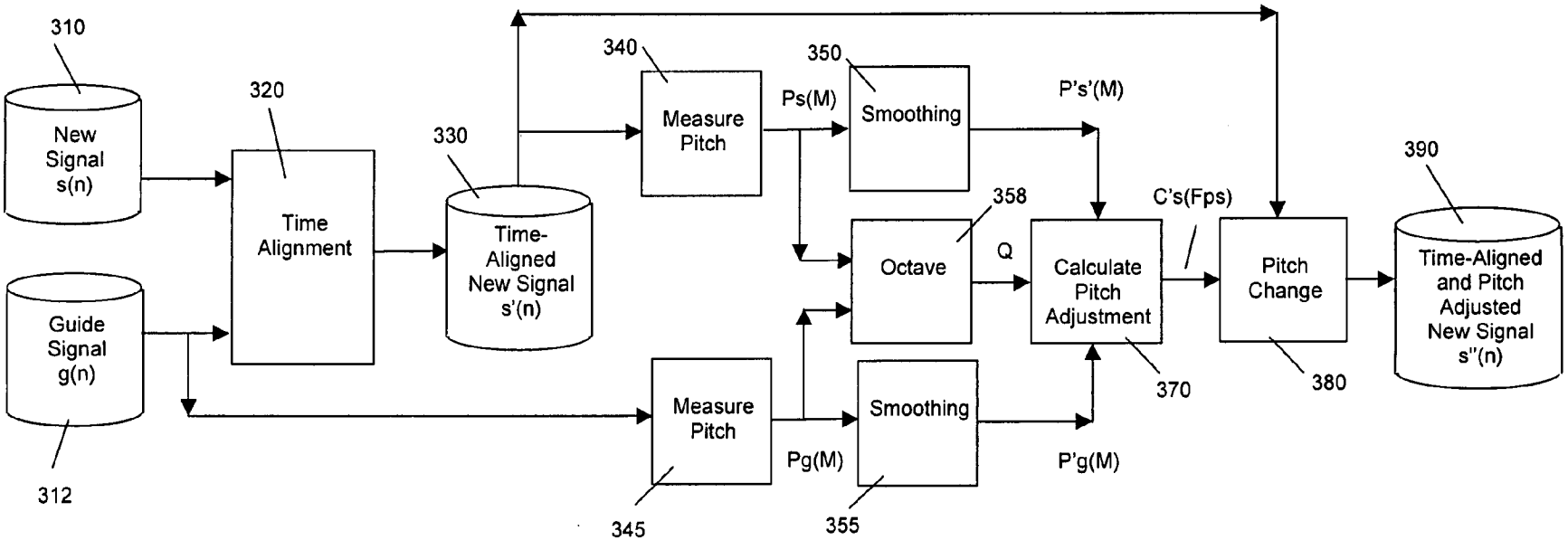
FIG. 3 is a block diagram of one embodiment of the present invention showing the signals and processing modules used to create an output audio signal with pitch adjustments based on an input signal with different pitch and timing characteristics.

The embodiment of FIG. 3 carries out the Method 1 described hereinbefore. The objective is to correct the pitch and timing of the user's New Signal to mimic the pitch and timing of the Guide Signal. In this case, the feature in the Guide Signal being used as a control function and the feature being modified in the New Signal are the same feature, namely the pitch contour of the respective signal. A process tracking the differences between time-aligned New Signal pitch measurements and the Guide Signal pitch measurements is used in computing a pitch adjustment function to make a modified New Signal's pitch follow that of the Guide Signal. It is assumed here that the New Signal, s(n) is similar in phrasing, content and length to the Guide Signal, g(n). For a non-real-time Karaoke-type application, this is a reasonable assumption, because the user is normally trying to mimic the original vocal performance in timing, pitch, and words.

Method 1 is here performed on the digital audio data in non-real time as follows.

Input Signal Description and Measurement

The New Signal and the Guide Signal are highly unlikely to be adequately time-aligned without processing. U.S. Pat. No. 4,591,928 (Bloom et. al.), describes the differences between the energy patterns of non-time-aligned but similar speech signals and the use of energy-related measurements such as filterbank outputs as input to a time alignment process.

Figure 4:
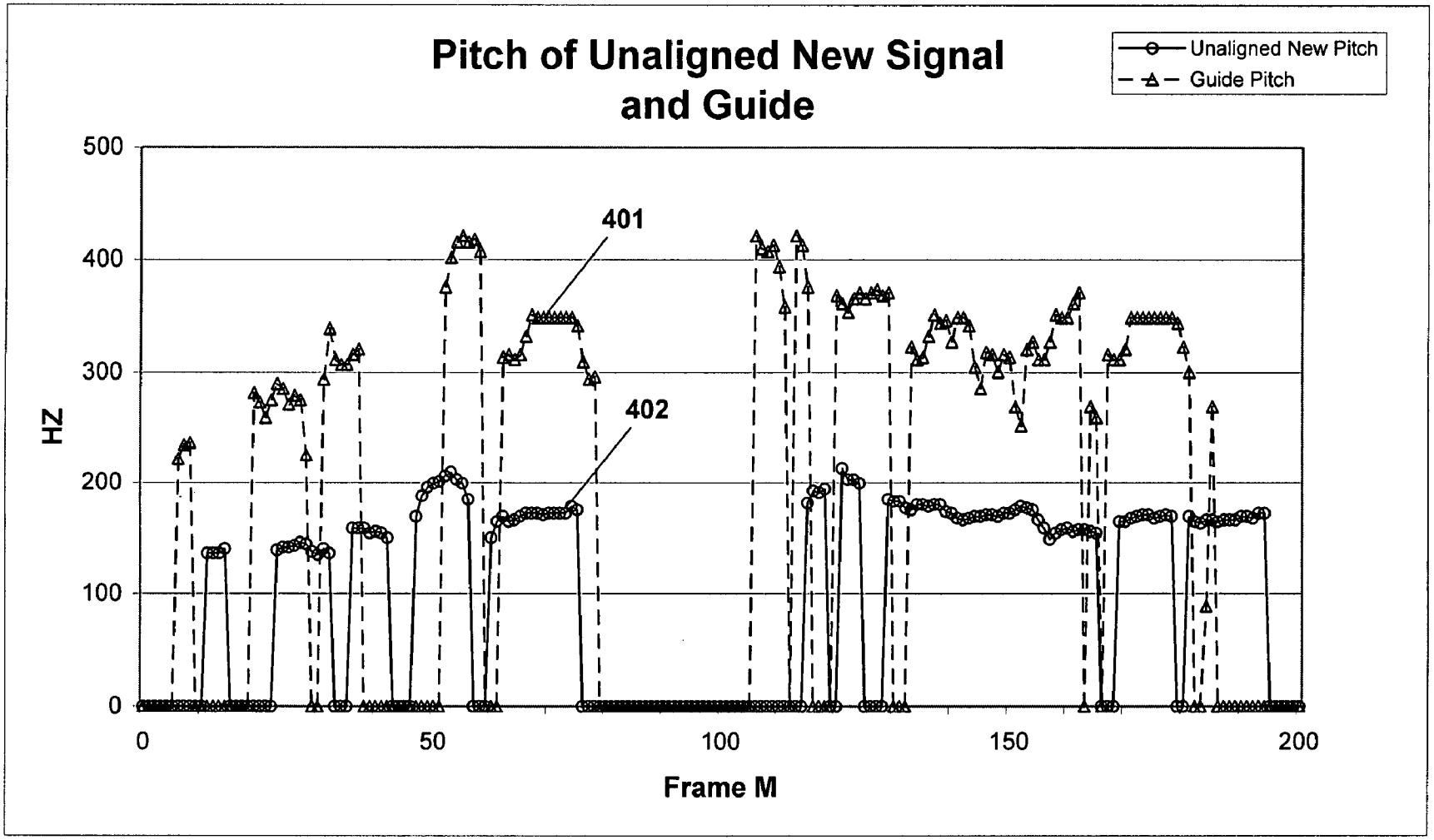
FIG. 4 is a graph showing a typical example of pitch measurements as a function of time for a professional singer's recorded Guide voice and the same measurements on a recorded New Signal from an untrained user singing the same song to the same musical accompaniment.

FIG. 4 illustrates a time series Pg(M) referred to hereinafter as a pitch contour 401, obtained by measuring the pitch of a professional female singer's Guide Signal, as a function of pitch measurement frame number M, where M=0, 1, 2, . . . N, and a time series Ps(M) shown as a pitch contour 402 of a typical amateur's New Signal (male voice) before time alignment along the same time scale. Differences in the pitch contours of both signals and also their misalignment in time are apparent. The first series, Pg(M), which is not aligned in time with the second series, Ps(M), cannot be directly used as a control or target pitch function for the second signal without generating significant and audible errors.

A data point shown as zero HZ in a pitch contour 401 or 402 indicates that the corresponding pitch measurement frame contains either silence or unvoiced speech. The non-zero measurements indicate the pitch measurement of the respective signal in that frame.

In FIG. 4 the non-zero value segments (pulses) of voiced sound in the New Signal pitch contour 402 generally both lag behind the corresponding features in the Guide Signal pitch contour 401 and have different durations. Also the voiced sounds of two pitch contours are in different octaves. Furthermore, the pitch range variation in each pulse of the Guide Signal pitch contour 401 is much wider than in the corresponding pulse in the New Signal pitch contour 402. This is expected since the Guide Signal pitch contour 401 is taken from a professional singer. It is such details and the timing of the Guide Signal pitch contour 401 that are to be imparted to the amateur user's recorded singing.

Time Alignment of New Signal

In FIG. 3, the sampled New Signal waveform, s(n), read from data store 310, is first aligned in time to the Guide Signal, g(n), read from data store 312, using a technique such as that described in U.S. Pat. No. 4,591,928 to create an intermediate audio signal, the Time-Aligned New Signal, s'(n), which is stored, e.g. on disk 330. This ensures that the details of the energy patterns in s'(n) occur at the same relative times as those in the Guide Signal. It further ensures that any required lip-syncing will be effective and any transfer of features from the Guide Signal to the New Signal needs no further time mapping. The sampling frequency used in creating the New Signal, s(n) and the Guide Signal g(n) in this example is 44.1 kHz.

The Time Alignment process described in U.S. Pat. No. 4,591,928 measures spectral energy features (e.g. a filterbank output) every 10 ms, and generates a time alignment or "time warping" path with a path point every 10 ms that associates similar spectral features in the New Signal with the closest corresponding features in the Guide Signal.

Figure 5:
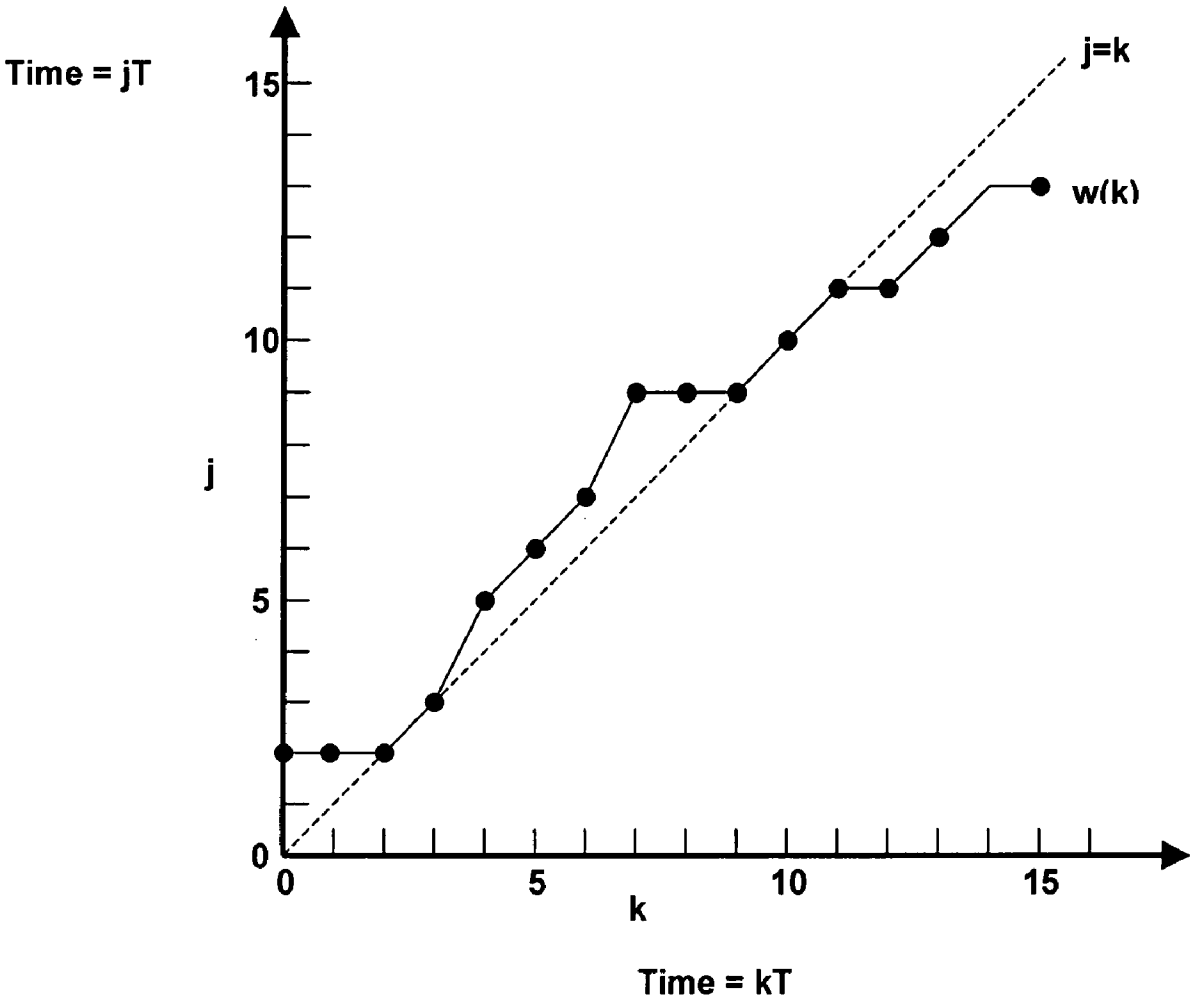
FIG. 5 is a graph representing a Time Warping function or Alignment path.

FIG. 5 shows an example of a time warping path, w(k), k=0, 1,2, . . . in which each feature frame of the New Signal has a frame number j and each feature frame of the Guide Signal has a frame number k, the frame sampling interval being T seconds, where T=10 ms. Such a warping path is created within a time-alignment processing module 320, and this path is used to control the editing (i.e. Time-Compression/-Expansion) of the New Signal s(n) in the module 320 in the creation of the time-aligned New Signal s'(n) stored on disk 330. As described in U.S. Pat. No. 4,591,928, the time-aligned New Signal, s'(n), is created by the module 320 by building up an edited version of s(n) in which portions of s(n) have been repeated or deleted according to w(k) and additional timing error feedback from the editing system, which is constrained to making pitch synchronous edits when there is voiced sound.

Generate Pitch Contour of New Signal

A raw pitch contour, Ps'(M), of the aligned New Signal, s'(n), is created from measurements of s'(n) taken using a moving analysis Hann window in consecutive discrete pitch measurement frames, where M is the frame number and M=1,2,3, . . . . To obtain accurate pitch measurements it is recommended that the length of the analysis window be 2.5 to 3.0 times the length of the lowest period being measured. Therefore, in the current embodiment, to measure pitch as low as 72 Hz with a period of approximately 0.0139 s., a 1536 sample (at 44.1 kHz sampling frequency) analysis window (or approximately 35 ms) is used. The sampling interval of a pitch measurement frame is 10 ms. The analysis window of the pitch estimator module 340 is centred in each pitch measurement frame of samples. For each pitch measurement frame, an estimate is made of the pitch using one of the well-known methods for pitch estimation (e.g. auto-correlation, comb filtering etc). Detailed descriptions of these techniques can be found in references such as Wolfgang Hess (1983) "Pitch Determination of Speech Signals. Algorithms and Devices," Springer-Verlag; R. J. McAulay and T. F. Quatieri. (1990); "Pitch estimation and voicing detection based on a sinusoidal model," Proc. Int. Conf. on Acoustics, Speech and Signal Processing, Albuquerque, N. Mex., pp. 249-252; and T. F. Quatieri (2002) "Discrete-Time Speech Signal Processing: Principles and Practice," Prentice Hall.

The measurements may be taken without overlap of analysis windows, but overlap of the successive windowed data of between 25 and 50% is generally recommended. In this embodiment, the measurement frame rate of M is 100 Hz (i.e. 10 ms intervals), which provides a sufficient overlap and also conveniently is the same as the measurement rate of the time alignment function. In order to make the first and last few pitch measurements correctly, in which the analysis window necessarily extends beyond the available data samples, both the start and end of the signal are padded with up to one analysis window's length of zero magnitude samples before taking those pitch measurements.

To create a final smoothed pitch contour, P's'(M) for the time-aligned New Signal, the pitch measurements of the individual frames are smoothed at a filter module 350 using a 3 point median filter followed by an averaging filter. In addition, silence and unvoiced frames of the time-aligned New Signal s'(n) are marked in P's'(M) as having zero pitch.

Generate Pitch Contour of Guide

Similarly, at a pitch estimator module 345 a pitch contour Pg(M) of the Guide Signal g(n) is created, using the same methods and parameters as described for creating the pitch contour Ps'(M), and smoothed at a filter module 355 to create a smoothed pitch contour P'g(M) for the Guide Signal.

Calculate Pitch Adjustment

The next process is calculation of the pitch adjustment or correction factor for each frame of the time-aligned New Signal. This is done by a pitch adjustment module 370 and takes into account the ratio of the Guide Signal pitch to the time-aligned New Signal pitch and any desired shifts in octave. The calculation is done for each pair of pitch measurement frames having the same frame number M. A low pass filter within module 370 then smoothes the correction factors. There are two steps: determination of octave and shifting of pitch of the New Signal. There are two main options considered with regard to the adjustment of pitch: a) adjustment of the output pitch to be the same as the pitch of the Guide Signal or b) maintaining the pitch range of the input New Signal so that the adjusted voice sounds the most natural. Octave adjustment to achieve this latter effect will now be described. An octave adjustment module 358 computes an octave multiplier, Q, which is kept constant for the duration of the signal. This emphasises the need to analyse all or at least a substantial amount of the New Signal before being able to set this value.

For each pitch analysis frame M of the time-aligned New Signal, the unsmoothed pitch estimates for frame M from the pitch estimator modules 350 and 355 are used to calculate a local pitch correction, $C_L(M)$, where M is the frame number, limiting the calculation to those frames where the time-aligned New Signal and its corresponding Guide Signal frame are both voiced, i.e. both of these frames have a valid pitch. In those frames, the local pitch correction factor $C_L(M)$, which would make the pitch of frame M of the time-aligned New Signal the same as the pitch of frame M of the Guide Signal, is given by $$C_L(M)=Pg(M)/Ps'(M) \quad (1)$$

Each ratio $C_L(M)$ is then rounded to its nearest octave by selecting powers of 2 in accordance with the following table:

| Ratio $C_L$ (M) | Octave | Comment |
|---|---|---|
| 0.5. up to .0.75 | 0.5 | New Signal is one octave |
| 0.75 up to 1.5 | 1.0 | New Signal is same octave |
| 1.5 up to 3 | 2.0 | New Signal is one octave |
| 3.0 up to 6.0 | 4.0 | New Signal is two octaves |
| etc | | lower |

All the resulting Octave values are entered into a histogram and then the Octave correction value, Q, that occurs most frequently is selected. Q is not a function of time in this case, but it can be in alternative embodiments. If desired, Q could be multiplied by another factor to achieve any desired offset in pitch frequency. The calculation of Q is performed in a module 358. The Octave correction value Q is supplied to a pitch adjustment module 370 and used in equation (2) below to produce an octave-corrected pitch correction factor, C(M) where $$C(M)=P'g(M)/(Q*P's'(M)) \quad (2)$$

where

C(M) is the pitch correction factor at frame M of the signals, and

P's'(M) and P'g(M) are the smoothed estimated pitch at frame M of the time-aligned New Signal and the Guide Signal respectively.

To generate a pitch correction signal, the pitch correction factor C(M) is calculated from equation (2) over all frames of the time-aligned New Signal, so that the pitch register of the modified time-aligned New Signal will most closely match that of the original New Signal.

If no corresponding Guide Signal pitch exists at a frame M, (i.e. either the Guide Signal is unvoiced or the time-aligned New Signal is slightly longer than Guide Signal) the last correction factor value at M−1 is reused. It would also be possible to use extrapolation to get a better estimation in this instance.

Examples of resulting correction processing values are: A correction factor, C(M), of 1.0 means no change to s'(n) at frame M; 0.5 means lower the pitch by one octave, 2.0 means raise the pitch by one octave, and so on.

Shift Pitch of New Signal

Each value C(M) in the pitch correction signal provides the correction multiplier needed for a corresponding frame M of samples of the time-aligned New Signal, s'(n). In this example, the frame rate of C(M) is chosen to be the same as that used by the time alignment algorithm, which is 100 frames per second or fps. In other words C(M) will have one hundred samples for every second of s'(n).

To function correctly, some pitch-shifting algorithms must have a frame rate much lower than that of the time-alignment algorithm; i.e. the sampling interval (analysis frame) is much longer. For example, time domain pitch shifting techniques usually have a frame rate of around 25 to 30 fps if they are to work down to frequencies of 50 to 60 Hz. However their frame rate need not be constant throughout the signal, and the rate can be varied, say, with the fundamental pitch of the signal s'(n). In the present embodiment, however, a fixed frame rate is used in pitch shifting.

In the present embodiment, the respective frame-rates for calculation of the pitch correction factor C(M) and operation of the pitch shifting algorithm are different, and therefore linear interpolation is used to derive an estimate of the pitch correction needed at the centre of each analysis frame of the pitch shifting algorithm from the C(M) samples closest in time to that centre. This interpolated correction factor is derived as follows:

A frame M of the pitch correction signal has a length equal to Lc samples of the New Signal s(n) where Lc is given by:

$$Lc=\text{sampling rate of New Signal } s(n)/\text{frame rate of } C(M) \quad (3)$$

The sample number along s'(n) at the centre of each of the analysis frames of the pitch shifting algorithm at which an estimate of the pitch correction is required is determined as follows.

If Nc(Fps−1) is the sample number along s'(n) at the centre of the pitch-shifting analysis frame Fps−1, then the sample number Nc(Fps) at the centre of the next frame, Fps, is:

$$Nc(Fps)=Nc(Fps-1)+Ls(Fps, To(Fps-1)) \quad (4)$$

where:

Fps is the pitch-shifting analysis frame number, Fps=0, 1, 2, . . . and

Ls(Fps, To(Fps−1))=New Signal's sampling rate/pitch-shifting algorithm Frame Rate.

In this general case, Ls is a function of the frame number Fps and To(Fps−1), the pitch period duration at Fps−1, to allow for a time-varying frame rate. In this embodiment, Ls is held constant and set to 1536 samples, i.e. 34.83 ms.

The initial values for the sample numbers along s'(n) at the centres of both the pitch shifting analysis frame before the first computed frame, Nc(−1), and the first computed frame, Nc(0), are dependent on the pitch-shifting algorithm. In this embodiment Nc(−1)=0.5*To(−1) and Nc(0)=0.

Using Nc(Fps) and Lc, the pitch correction frame numbers Fc(M) of C(M) which bound or include the sample at the centre of a specific analysis frame Fps in the pitch-shifting algorithm are:

$$Fc(Fps)=Nc(Fps)/Lc. \quad (5)$$

where:

/ represents integer division,

Fc(Fps) is the frame of C(M) occurring just before or at the centre of the pitch-shifting algorithm frame Fps, and Lc is as defined above.

If Fc(Fps) is the pitch correction frame occurring just before or at the centre of the pitch shifting algorithm frame then (Fc(Fps)+1) will be the next pitch correction frame occurring after its centre.

Linear interpolation between the pitch corrections C(Fc(Fps)) and C(Fc(Fps)+1)) gives an interpolated correction factor Cs(Fps) at the centre of the pitch-shifter's analysis frame to control the pitch shifter:

$$Cs(Fps)=C(Fc(Fps))*(1-\text{alpha})+\text{alpha}*C(Fc(Fps)+1) \quad (6)$$

where:

$$\text{alpha}=(Nc(Fps)-Lc*Fc(Fps))/Lc.$$

and where

/ represents integer division, and other symbols are as described above.

Figure 6:
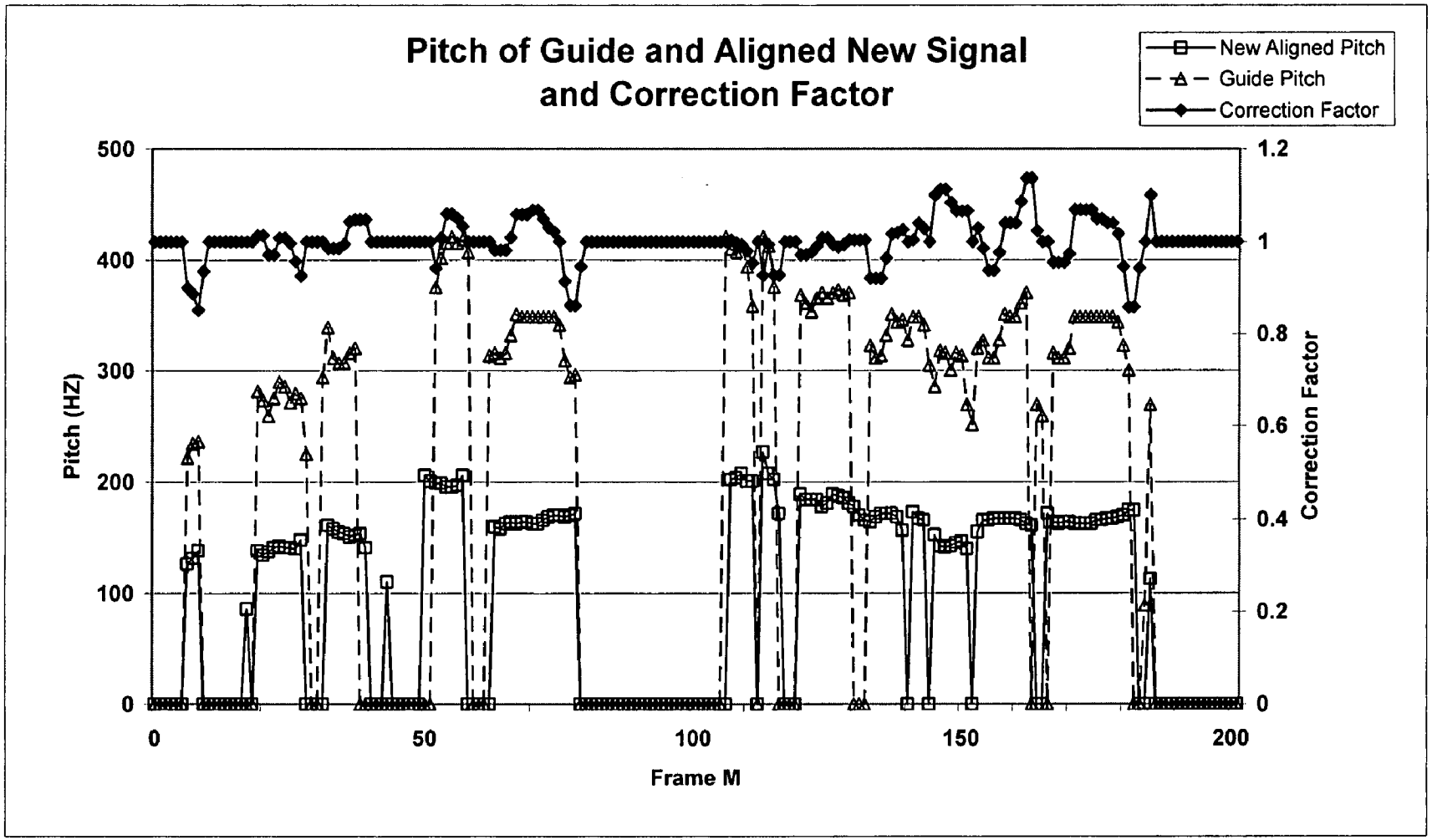
FIG. 6 is a graph showing against the left frequency axis the pitch of the Guide Signal and the Aligned New Signal pitch from FIG. 4 (before pitch correction) and computed smoothed pitch Correction Factor against the right vertical axis.
Figure 7:
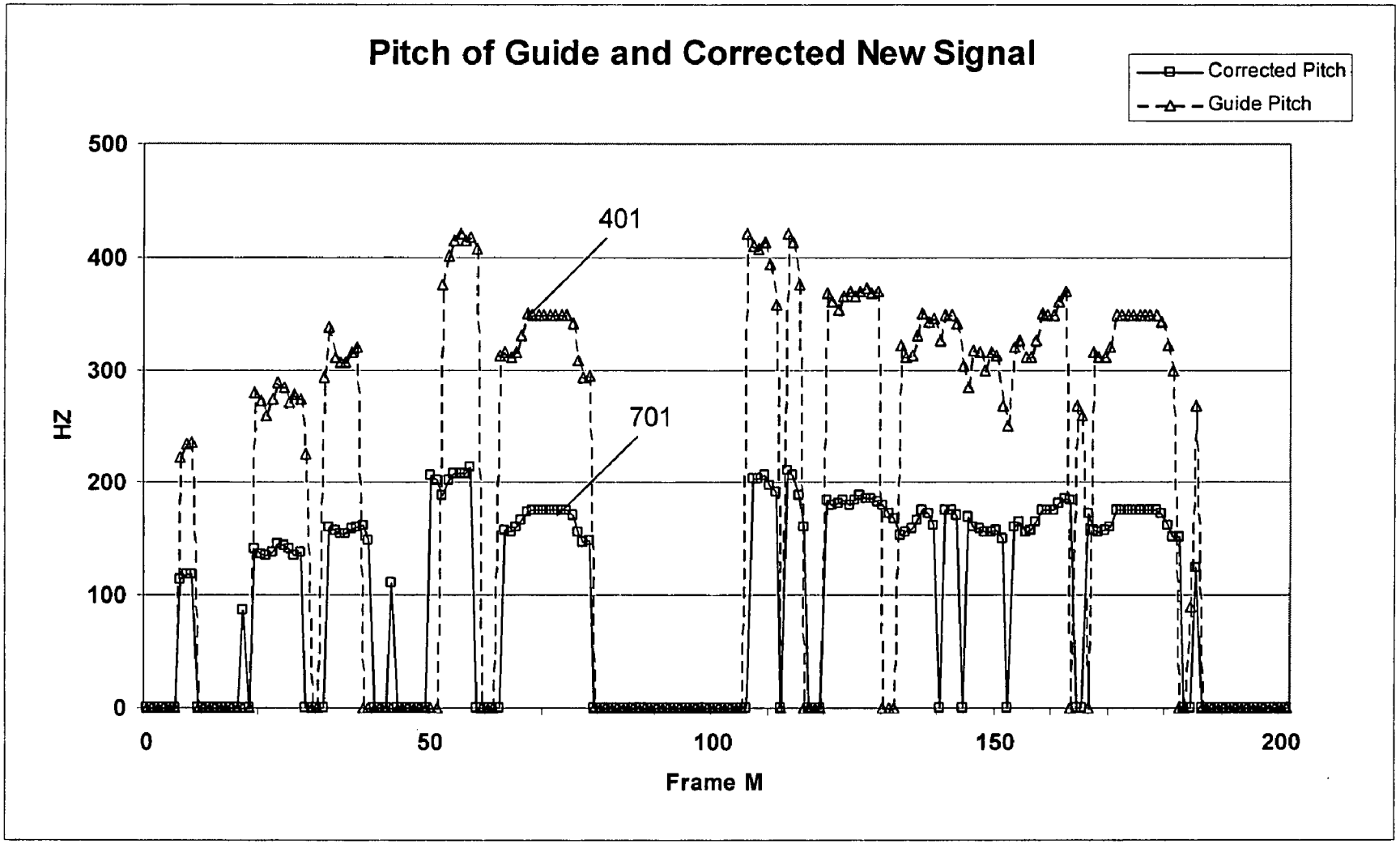
FIG. 7 is a graph of the pitch of the Guide Signal and the Corrected New Signal pitch that was shown uncorrected in FIG. 6.

The interpolated correction factor value Cs(Fps) is smoothed by simple low pass filtering to become C's(Fps) and is represented as the output of module 370 which is supplied to the pitch changer module 380. For pitch correction, the time-aligned New Signal s'(n) is processed in frames Fps corresponding to the pitch-shifting algorithm frames. Each such frame, Fps, of the time-aligned New Signal s'(n) is shifted dynamically in pitch by its smoothed correction factor at module 380 and the resulting pitch-corrected and time-aligned New Signal, s"(n), is written to disk 390 for subsequent playback with the backing music and optionally the corresponding music video if available. This output signal, s"(n) will have both the required time-alignment and pitch correction to be played back as a replacement for the Guide Signal g(n) or synchronously with it. An example of the time-aligned and corrected pitch contour 701 that would be observed in s"(n) as a result of multiplying pitch values of the time-aligned New Signal s'(n) by the corresponding correction factor values illustrated in FIG. 6 is shown in FIG. 7. Most of the details of the Guide Signal pitch contour 401 now appear in this example of a computed modified pitch contour 701.

The pitch shifting performed by the module 380 to create the pitch corrected time-aligned output signal waveform, s"(n) at store 390 can be achieved using any of the standard pitch-shifting methods such as TDHS, PS-OLA, FFT, which are described in references such as K. Lent (1989), "An efficient method for pitch shifting digitally sampled sounds," Computer Music Journal Vol. 13, No. 4, at pages 65-71; N. Schnell, G. Peeters, S. Lemouton, P. Manoury, and X. Rodet (2000), "Synthesizing a choir in real-time using Pitch Synchronous Overlap Add (PSOLA)," International Computer Music Conference, at pages 102-108; J. Laroche and M. Dolson (1999), "New Phase-Vocoder Techniques for Pitch-Shifting, Harmonizing and other Exotic Effects." Proc. 1999 IEEE Workshop on Applications of Signal Processing to Audio and Acoustics at pages 91-94; G. Peeters (1998), "Analyse-Synthese des sons musicaux par la methode PSOLA," Proceedings of the Journees d'Informatique Musicale, Agelonde, France; and V. Goncharoff and P. Gries (1998), "An algorithm for accurately marking pitch pulses in speech signals", Proceedings of the IASTED International Conference Signal and Image Processing (SIP'98), October 28-31.

In this embodiment a time domain algorithm substantially as described in D. Malah (1979) "Time Domain Algorithms for Harmonic Bandwidth Reduction and Time Scaling of Speech Signals", IEEE Transactions Acoustics, Speech and Signal Processing, Volume 27, No. 2, pages 121-133, is used at module 380 to shift the pitch of the signal s'(n).

At every frame Fps of s'(n) the pitch period, defined here as To(Fps), is measured. For simplicity hereinafter, although variables based on computations that include To(Fps) are also variables of Fps, the parameter Fps is not made explicit in those expressions.

Figure 10:
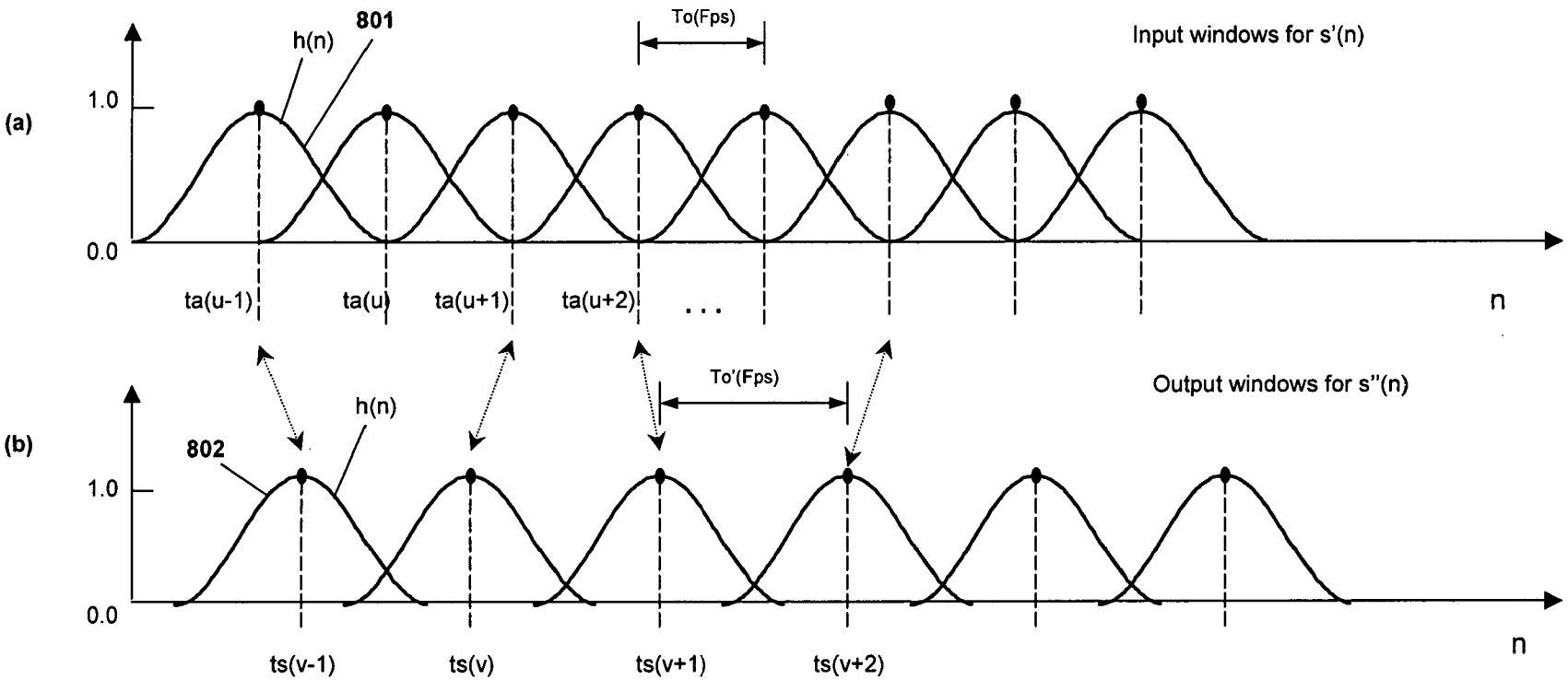
FIG. 10 (*a*) is a graphic representation of an example of the relative positions and shapes of the analysis windows used to create a signal s"(n) using overlap and add synthesis.

In this embodiment the time-aligned New Signal s'(n) is decomposed into a sequence of windowed samples s'(u,n) of the signal by multiplying s'(n) with h(p), an analysis window function 801 (shown in FIG. 10(*a*)) which is shifted periodically in time, so that:

$$s'(u,n)=h(n)*s'(n-ta(u)) \tag{7}$$

where

- h(p) is the pitch shifting analysis window of length P samples, the length of which in time is equal to twice the measured pitch period of the frame Fps, i.e. 2*To(Fps). In this embodiment h(p) is a Hann window of P samples.
- ta(u) is the u-th analysis instance that is set at a pitch synchronous rate for voiced frames, such that ta(u)−ta(u−1)=To(Fps), where u=0,1,2 . . . . For unvoiced frames ta(u) is set to a constant rate of 10 ms. It could also be set to the last valid value of To from a voiced frame.

From the smoothed pitch correction C's(Fps) the new output period To'(Fps) of the corrected signal is calculated. For unvoiced signals, in frame Fps, To'(Fps)=To(Fps). For voiced signals in frame Fps, $$To'(Fps)=To(Fps)/C's(Fps) \tag{8}$$

From this processing, a sequence 802 of short-term synthesis windows ts(v) is generated which is synchronized to the new output period To'(Fps) such that $$ts(v)-ts(v-1)=To'(Fps) \tag{9}$$

where:

ts(v) is the v-th synthesis instance in the output frame.

As illustrated by FIGS. 10 (*a*) and (*b*), for each ts(v) that window ta(u) of s'(n) data which is closest in time is selected. The selected window ta(u) of s'(n) data is then added to an output stream buffer (not shown) to generate an output signal stream s"(n) one frame at a time by the known method of overlap and add which combines all the short-term synthesis windows, ts(v) of one frame Fps. In effect, windowed samples s'(u,n) are recombined with a pitch period of To'(Fps) rather than with a period of To(Fps).

Further embodiments will now be described.

In addition to pitch, which includes vibrato and inflection curves, many other features of sound signals are measurable and can be modified. Examples are instantaneous loudness, glottal characteristics, speech formant or resonant patterns, equalization, reverberation and echo characteristics. Moreover, the New and Guide Signals are not necessarily restricted to having prosodic, rhythmic or acoustical similarities.

Figure 8:
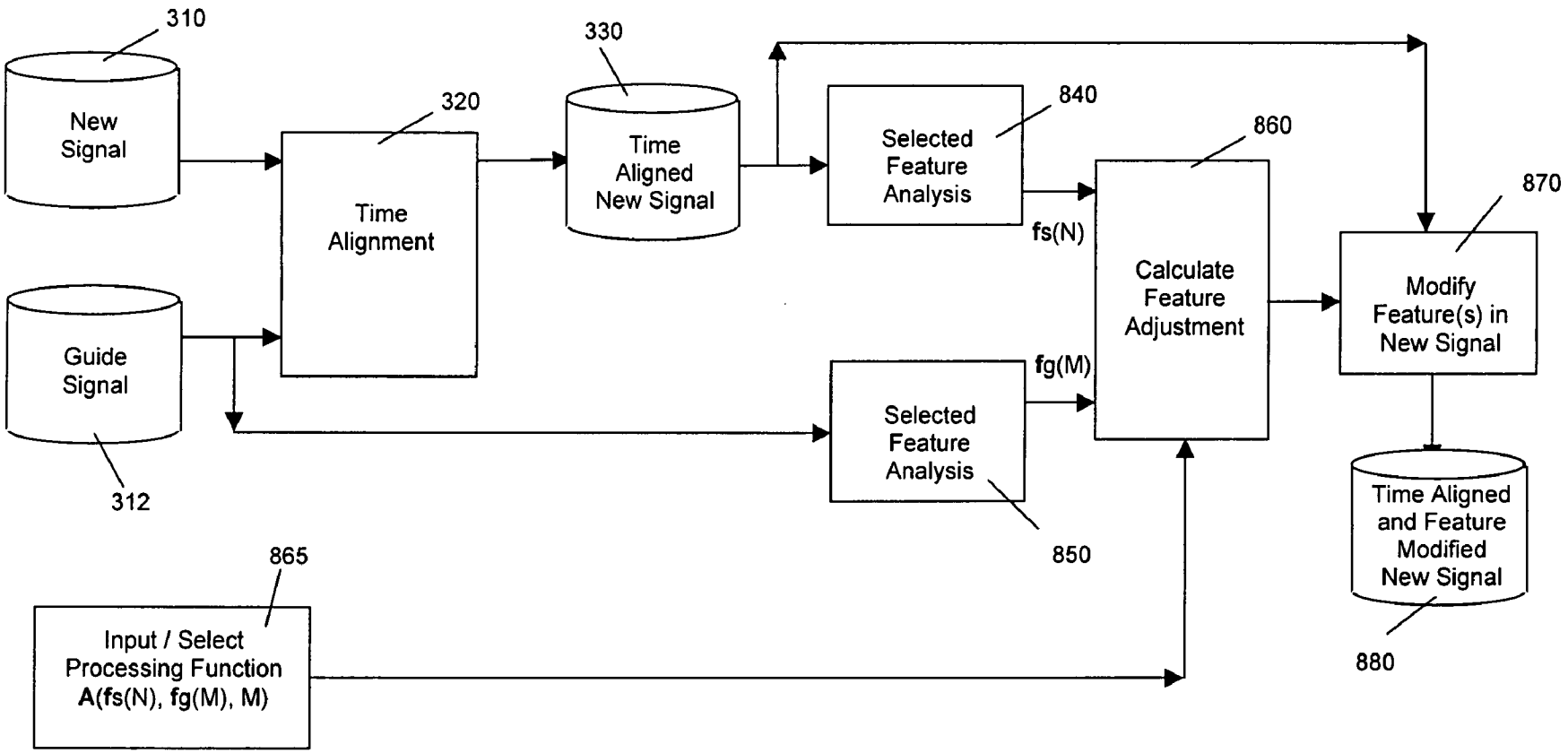
FIG. 8 is a block diagram of another embodiment of the present invention showing the signals and processing modules used to create an output audio signal with any general signal feature modifications based on time-aligned features of an arbitrary input signal.

In FIG. 8 a feature analysis operation is shown acting on the New Signal and the Guide Signal at modules 840 and 850 respectively, to create fs(N) and fg(M). These are indicated in bold as feature vectors, specifying the selected features measured at frames N and M respectively. These vectors need not be of the same features. While fg (M) must contain at least one feature, fs(N) can, in a further embodiment, be a null vector with no feature.

A feature adjustment function, A(fs(N), fg(M), M), must be provided and here is input to the system as a processing specification from a source 865. This function defines the desired relationship between the two signals' feature vectors at frames N and M, where these may or may not be the same frame, the elapsed time, as represented by frame parameter M, and the time-varying signal modification process implemented in software applied at module 870. This function and variations would generally be defined and input by the system programmer and consequently can be presented as a set of presets and/or offer user-defined variations that can be selected by the system user.

An example of using two different features in A(fs(N), fg(M), M), is having the loudness of the Guide Signal control the centre frequency of a moving bandpass filter process on the New Signal with the condition that the New Signal contain energy within the moving bandpass filter's band. Making A a function of M also generalizes the process to include possible time-based modifications to the function.

Figure 9A:
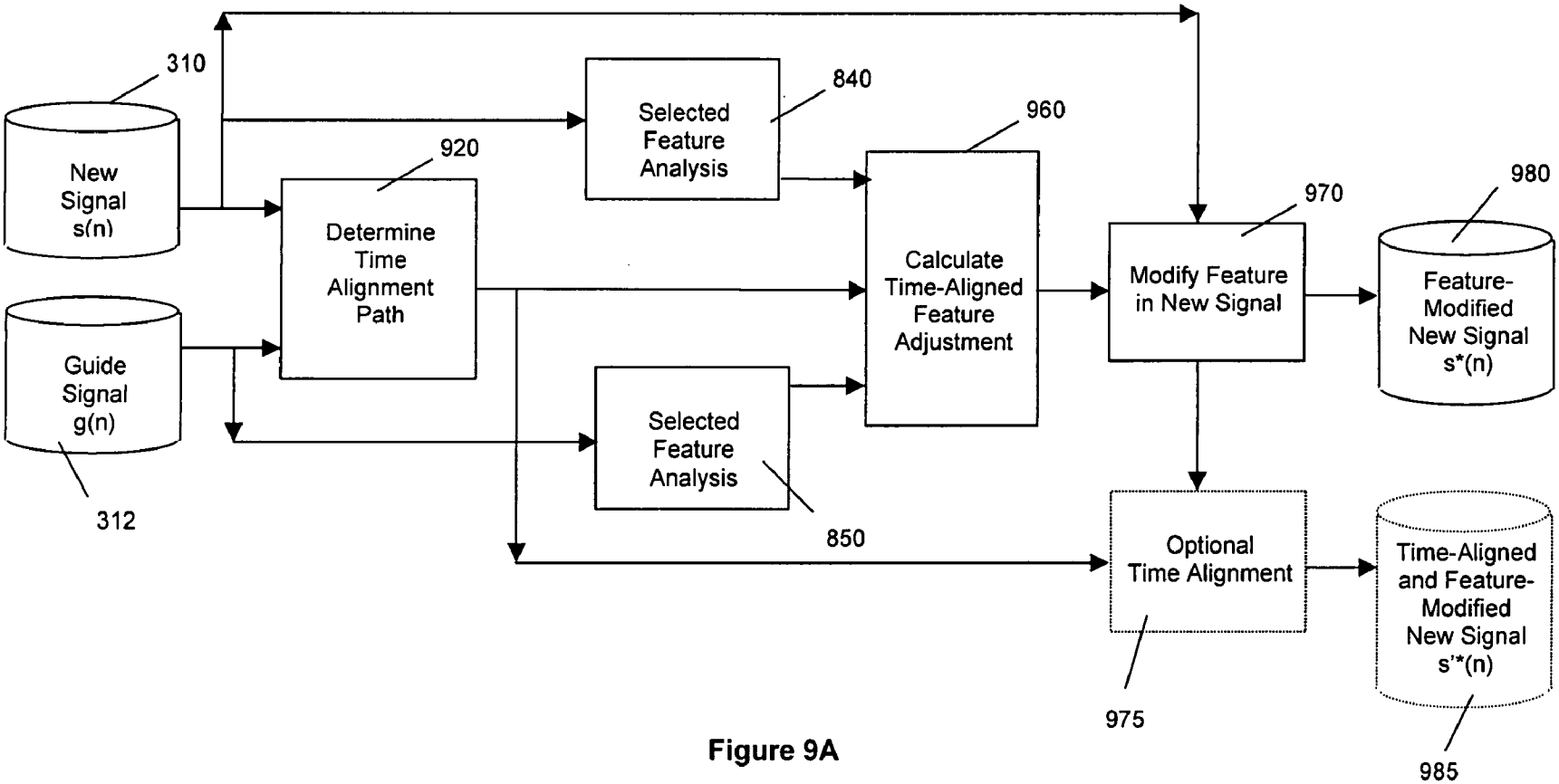
FIG. 9A is a block diagram of a further embodiment having in accordance with the present invention processing in which the features of the New Signal are modified with or without simultaneous time alignment to a Guide Signal.

Another embodiment, employing the Method 2 described hereinbefore, is shown in FIG. 9A in which a time-aligned New Signal waveform is not generated as a first step. Instead the time-alignment data, obtained as in the embodiment of FIGS. 3 and 8 in a module 920, is used to time distort in a module 960, the measured features of the Guide Signal to the appropriate times in the New Signal. Module 970 makes the time-aligned modifications to the New Signal. An optional time-alignment can be performed on the modified New Signal in the feature modification process module 970 at the same time (combining the processing of modules 970 and 975 into one algorithm), or in a subsequent process module 975 on the feature modified signal. Further details of this approach are given below.

The inverse of the time-alignment function in FIG. 5 maps matching frames of the Guide Signal at frame k to each frame of the New Signal at frame j. If Fs is a frame number of the New Signal and W(Fs) is the (inverse) time warping function (or mapping function) generated by the time alignment process module 920 then $$Fag(Fs)=W(Fs) \tag{10}$$

where Fag is the corresponding frame number of the time-aligned Guide.

From this mapping a time-aligned or warped version of the Feature Adjustment function is generated and used in adjustment module 960 in FIG. 9A.

As an example, returning to the application in pitch correction, a warped version of the pitch correction function, based on equation (1), is computed as:

$$C(Fs)=Pg(Fag(Fs))/Ps(Fs) \quad (11)$$

From (10) and (11)

$$C(Fs)=Pg(W(Fs))/Ps(Fs) \quad (12)$$

where C(Fs) is the correction factor of frame Fs of the New Signal.

Ps(Fs) is the estimated pitch of frame Fs of the New Signal. W(Fs) is the corresponding frame in the Guide from the warping function. Further processing of C(Fs) as described previously, including the octave modifications (if desired) takes place in adjustment module 960 which then provides a modification function, based on equation (2), given by $$C(Fs)=P'g(W(Fs))/(Q*P's(Fs)) \quad (13)$$

This modification function is applied to s(n) at modification module 970 on a frame-by-frame basis to produce a modified output, s*(n).

The processing shown in FIG. 9A is generalized as in the description of FIG. 8 to allow any signal features to be specified for analysis and modification, but is different in that the modified output s*(n) in store 980 is not time-aligned with the Guide Signal but has instead the timing of the original New Signal s(n). Time alignment of the modified output s*(n) to the Guide Signal g(n) can be achieved for pitch modification in a single process where feature modification in module 970 and time alignment in a module 975 are executed simultaneously. Descriptions of methods for implementing, for example, simultaneous pitch and time modification (which may reduce potential processing artefacts and improve computational efficiency) are found in references such as J. McAulay and T. Quatieri (1992), "Shape Invariant Time-Scale and Pitch Modification of Speech", IEEE Trans. Sig. Processing, IEEE Trans. Sig. Processing, March, Vol. 40 No. 3, pp 497-510 and D. O'Brien and A. Monaghan (1999), "Shape Invariant Pitch Modification of Speech Using a Harmonic Model", EuroSpeech 1999, pp 1059-1062. These references assume either an arbitrary constant pitch shift or a constant pitch shift based on measurements of the original signal to determine the amount of shift to apply. For example if unvoiced frames are detected in the original voice waveform, it is normal practise to switch off, or at least reduce, any time or pitch modifications applied during that frame.

Optionally, the normal time alignment function can also be applied to a non-linear editing process in module 975 to create a signal s'*(n), which is a time-aligned version of the feature modified New Signal s*(n).

Figure 9B:
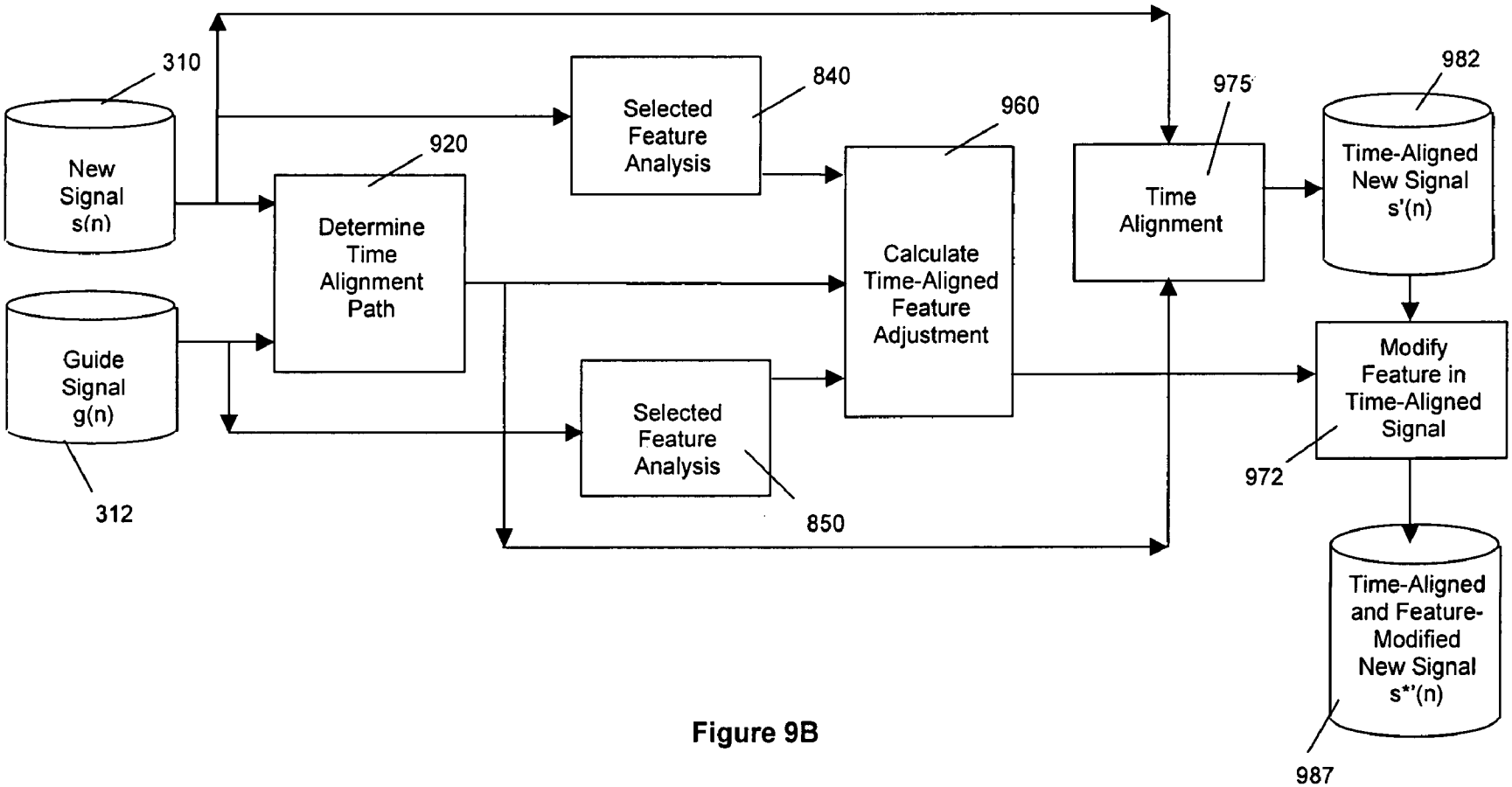
FIG. 9B is a block diagram of a further embodiment having in accordance with the present invention processing in which the Time Alignment path is used to both create a Time-Aligned New Signal and to provide a mapping function for accurately determining the modifications to be made to the Time-Aligned New Signal.

Another embodiment, which performs Method 3, is illustrated in FIG. 9B, in which a time-aligned signal s'(n) in a storage module 982 is created by module 975 using the original time-alignment path created in module 920. In this arrangement, a New Signal feature contour is produced by module 840 from the unmodified New Signal s(n), and a Guide Signal feature contour is produced by module 850. In module 960, the equation:

$$C(M)=P'g(M)/Q*P's(w(M)) \quad (14)$$

where w(M) is the time warping path generated by module 920, is implemented to produce the feature modification contour C(M).This modification contour is applied in module 972 to the time-aligned New Signal to create the time-aligned and feature modified New Signal, s*'(n), in output storage module 987.

In further embodiments, the Guide Signal can be made up of a series of different individual signals instead of one continuous signal, or multiple Guide Signals (e.g. harmony vocals) can be used to generate multiple vocal parts from a single New Signal.

In further embodiments, features in the New Signal do not have to be measured or input to the New Signal feature adjustment calculations and can simply be modified based on measurements of a feature or features of the Guide Signal. An example of this could be the application of reverberation or EQ to the New Signal as functions of those features in the Guide Signal.

It will be appreciated that the processing modules used in the embodiments described hereinbefore will be software modules when implemented in a system such as the system 100 of FIGS. 1 and 2 but may in alternative implementations be hardware modules or a mixture of hardware and software modules.

One application of the invention is for creating personalised sound files with a user's voice that can provide, for example, a telephone ringtone on a mobile phone or computer-based telephone system. Other examples include replacing any of the ringing or other sounds that can be presented to the caller or call recipient during a phone call or other data exchange. Such exchanges can take place via a telephone networks, VoIP (Voice Over Internet Protocol) systems or other message delivery system. Further examples include the generation of personalised sound files for any device or system that can use a personalised pre-recorded message.

Figure 11:
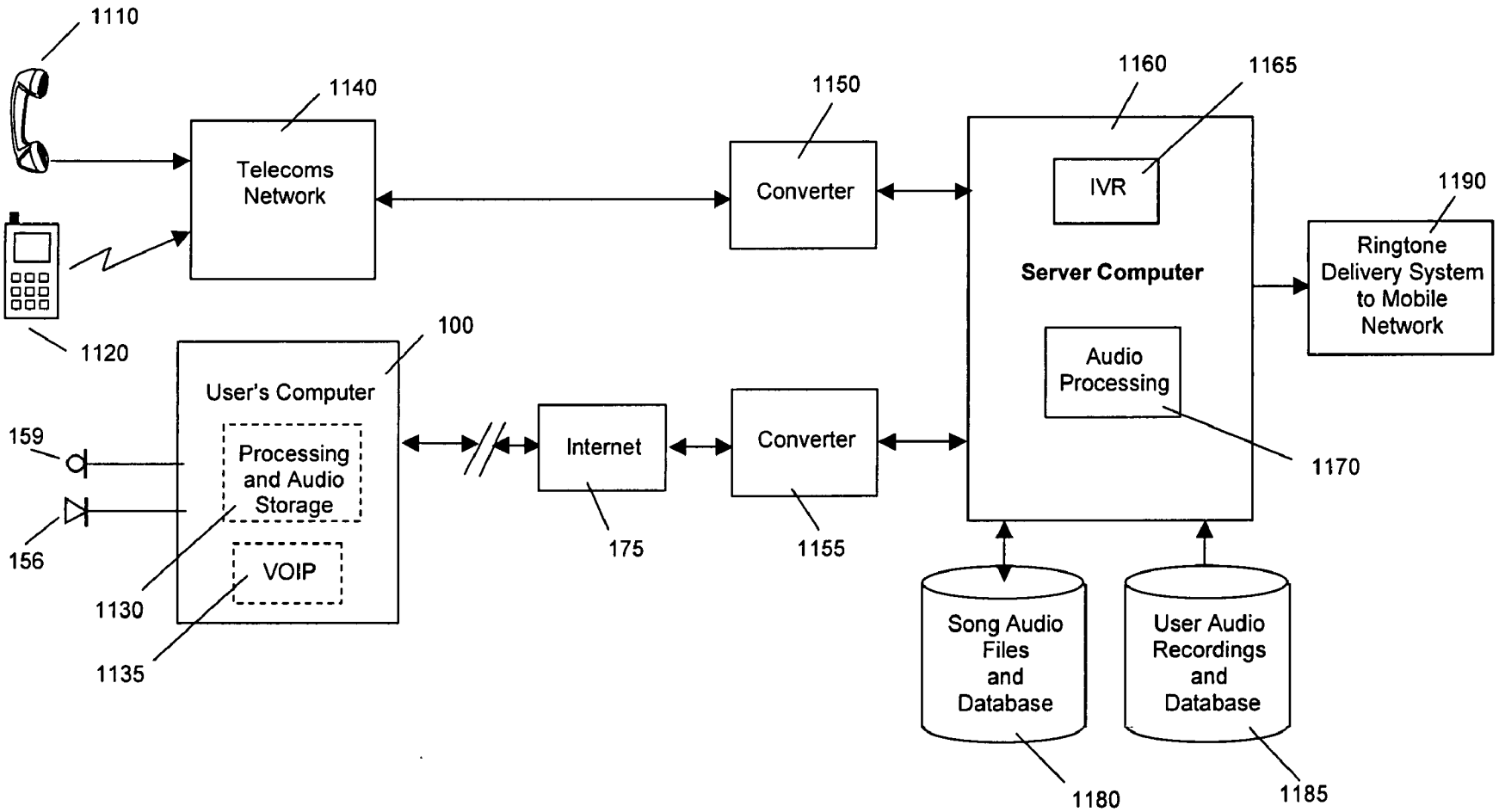
FIG. 11 is a block diagram of a further embodiment of the invention utilising a telecommunications system.

FIG. 11 illustrates an embodiment of the invention for enabling a user to generate, send and receive such sound files. In operation, the user initiates a telephone call from landline handset 1110 or mobile phone handset 1120 and through a telecommunications network 1140. An appropriate converter 1150 receives the signal from the telecommunication network 1140 and converts it into digital audio signals and operational command tones, and these are processed by a server computer 1160. The server computer 1160 can optionally provide Interactive Voice Response (IVR) from a module 1165 to give the user choices and feedback on operations.

The server computer 1160 can be implemented in one or more computers and incorporates audio processing modules 1170 for implementing the processes as described in FIG. 3 or 8 or 9A or 9B. The computer 1160 accesses a storage module 1180 for storing song audio files and a database for referencing those song files. The computer 1160 also stores in a storage module 1185 original and processed user audio recordings and a database for referencing those recordings.

The server computer 1160 interprets touchtone or other signals to initiate operations. For example, with the telephone keypad in this implementation, the user can instruct the computer 1160 to:

(a) Select a "track", e.g. a portion of a song (stored in module 1180);

(b) Transmit the selected track through the converter 1150 and network 1140 to the telephone handset 1110 or 1120 for the user to hear and rehearse to.

(c) Record the user's voice while the selected track is replaying through the telephone handset 1110 or 1120 and the user is singing into the handset microphone;

(d) Replay the processed recording of the user's voice mixed with the appropriate backing track (e.g. a version of the track without the original singer's voice)

In step (c), the user's voice is recorded in the storage module 1185, processed via the processing module 1170, implementing processing such as that shown in FIG. 3 or 8 or 9A or 9B and the result stored in module 1185.

Lastly, the user then enters a recipient's mobile phone number with the keypad of his/her handset 1110 or 1120. The computer 1160 then sends a data message to the recipient's number using a ringtone delivery system 1190 such as "WAP push" system. This data message gives the recipient the information required to download the processed audio to his mobile telephone or other device.

In an alternative implementation, a user's computer 100 with microphone 159 and speaker 156 is used to access the server computer 1160 directly via the Internet 175 or by a telephone call using VoIP software 1135. The user can then go through the same procedure as previously described, but listens and records by means of the computer 100 and sends commands entered on the keyboard 125 (not shown) of the computer 100 to the server computer 1160. The user can finally specify a mobile phone by its number to receive the created sound file through the delivery system 1190. The sound file can also be used in the user's computer 100 or another specified computer (such as a friend's computer) as a ringtone or other identifying sound file in the VOIP system of the specified computer.

In another alternative implementation in which the user accesses the server computer 1160 via the Internet, some or all of the processing modules of FIGS. 3, or 8, or 9A or 9B can be downloaded to the user's computer 100 as represented by a module 1130. A sound file resulting from the use of the module 1130 with or without the assistance of an audio processing module at the server computer 1160 and stored either on the user's computer 100 or the storage module 1185 can be sent via the Internet 175 or telecommunications network 1140 to a requested destination phone or other personal computer.

In further embodiments, the processes can be implemented wholly or in part in phones or any other devices that contain a computer system and memory and means for inputting and outputting the required audio signals.

In a further embodiment video signals (such as music videos) can be provided from the server computer 1160 with the song audio files that the user receives. The user can replay these audio and video signals and make sound recordings as described previously. The processed file, mixed with the backing track and synchronized video, is delivered to the designated telephone, personal computer or other device capable of playing an audio/visual file.

The song audio files are not restricted to songs and can be any sound recording, including speech, sound effects, music or any combination of these.

The invention claimed is:

1. A method for modifying at least one acoustic feature of an audio signal, the method comprising:

comparing first and second sampled audio signals so as to determine time alignment data from timing differences between the times of occurrence of time-dependent features in the second signal and the times of occurrence of time-dependent features in the first signal;

measuring at selected positions along the first signal at least one acoustic feature of the first signal to produce therefrom a sequence of first signal feature measurements;

processing the sequence of first signal feature measurements to produce a sequence of feature modification data; and applying the sequence of feature modification data to the second signal to modify at least one acoustic feature of selected portions of the second signal in accordance with the time alignment data.

2. A method according to claim 1, wherein the method includes the step of measuring at selected positions along the second signal the said at least one acoustic feature of the second signal to produce therefrom a sequence of second signal feature measurements, and the step of processing the sequence of first signal measurements includes comparing the first signal feature measurements with the second signal feature measurements and determining the feature modification data from such comparison.

3. A method according to claim 1, wherein the said step of applying the feature modification data includes the steps of using the time alignment data to produce from the second sampled signal a time-aligned second signal and applying the feature modification data to the time-aligned second signal.

4. A method according to claim 2, wherein the said processing step includes the step of using the time alignment data with the first signal feature measurements to produce the feature modification data in time alignment with the second signal feature measurements.

5. A method according to claim 1, wherein the step of applying the feature modification data includes modulating the feature modification data in accordance with a predetermined function so as to modify the said at least one acoustic feature of the said selected portions of the second signal jointly by the feature modification data and the predetermined function.

6. A method according to claim 1, wherein the said at least one acoustic feature of the first signal is pitch.

7. A method according to claim 1, wherein the said at least one acoustic feature of the second signal is pitch.

8. A method according to claim 1, wherein the said time-dependent features of the first and second signals are sampled spectral energy measurements.

9. A method according to claim 1, wherein the said at least one acoustic feature of the first signal is pitch and the said at least one acoustic feature of the second signal is pitch, and the said processing step includes the step of determining from values of ratio of pitch measurement of the first signal to time-aligned pitch measurement of the second signal a multiplier factor and so including the said factor in said step of applying the feature modification data as to shift the frequency range of pitch changes in the second signal in the modified selected signal portions.

10. A method according to claim 9, further including the step of scaling the said multiplier factor by a power of 2 so as to change pitch in the said modified selected signal portions in accordance with a selection of the said power of 2.

11. A method according to claim 2, wherein the step of measuring at selected positions along the second signal includes the steps of using the time alignment data to produce from the second sampled signal a time-aligned second signal in which the times of occurrence of the said time-dependent features of the second sampled signal are substantially coincident with the times of occurrence of the said time-dependent features in the first sampled signal, and measuring the at least one acoustic feature in the time-aligned second signal at positions along the time-aligned second signal selected to be related in timing with the said selected positions along the first sampled signal.

12. A method according to claim 2, wherein the said at least one acoustic feature of the first sampled signal is pitch, the said at least one acoustic feature of the second sampled signal is pitch, the said step of applying the feature modification data includes the steps of using the time alignment data to produce from the second sampled signal a time-aligned second signal and applying the feature modification data to the time-aligned second signal to produce a pitch modified time-aligned second signal.

13. A method according to claim 12, wherein the step of applying the feature modification data includes modulating the feature modification data in accordance with a predetermined function so as to modify pitch in the said selected portions of the second signal jointly by the feature modification data and the predetermined function.

14. A method according to claim 13, wherein the predetermined function is a function of the values of the ratio of pitch measurement in the first sampled signal to corresponding pitch measurement in the second sampled signal along the second sampled signal.

15. Apparatus for modifying at least one acoustic feature of an audio signal, the apparatus comprising:

means for comparing first and second sampled audio signals so as to determine time alignment data from timing differences between the times of occurrence of time-dependent features in the second signal and the times of occurrence of time-dependent features in the first signal;

means for measuring at selected positions along the first signal at least one acoustic feature of the first signal to produce therefrom a sequence of first signal feature measurements;

means for processing the sequence of first signal feature measurements to produce a sequence of feature modification data; and means for applying the sequence of feature modification data to the second signal to modify at least one acoustic feature of selected portions of the second signal in accordance with the time alignment data.

16. Apparatus according to claim 15, further including means for measuring at selected positions along the second signal the said at least one acoustic feature of the second signal to produce therefrom a sequence of second signal feature measurements, and wherein the means for processing the sequence of first signal measurements includes means for comparing the first signal feature measurements with the second signal feature measurements and determining the feature modification data from such comparison.

17. Apparatus according to claim 15, wherein the said means for applying the feature modification data includes means for using the time alignment data to produce from the second sampled signal a time-aligned second signal and applying the feature modification data to the time-aligned second signal.

18. Apparatus according to claim 16, wherein the said processing means includes means for using the time alignment data with the first signal feature measurements to produce the feature modification data in time alignment with the second signal feature measurements.

19. Apparatus according to claim 15, wherein the means for applying the feature modification data includes means for modulating the feature modification data in accordance with a predetermined function so as to modify the said at least one acoustic feature of the said selected portions of the second signal jointly by the feature modification data and the predetermined function.

20. Apparatus according to claim 15, wherein the said at least one acoustic feature of the first signal is pitch.

21. Apparatus according to claim 15, wherein the said at least one acoustic feature of the second signal is pitch.

22. Apparatus according to claim 15, wherein the said time-dependent features of the first and second signals are sampled spectral energy measurements.

23. Apparatus according to claim 15, wherein the said at least one acoustic feature of the first signal is pitch and the said at least one acoustic feature of the second signal is pitch, and the said processing means includes means for determining from values of the ratio of pitch measurement of the first signal to time-aligned pitch measurement of the second signal a multiplier factor and so including the said factor in applying the feature modification data as to shift the frequency range of pitch changes in the second signal in the modified selected signal portions.

24. Apparatus according to claim 23, further including means for scaling the said multiplier factor by a power of 2 so as to change pitch in the second modified selected signal portions in accordance with a selection of the said power of 2.

25. Apparatus according to claim 16, wherein the means for measuring at selected positions along the second signal includes means for using the time alignment data to produce from the second sampled signal a time-aligned second signal in which the times of occurrence of the said time-dependent features of the second sampled signal are substantially coincident with the times of occurrence of the said time-dependent features in the first sampled signal, and means for measuring the at least one acoustic feature in the time-aligned second signal at positions along the time-aligned second signal selected to be related in timing with the said selected positions along the first sampled signal.

26. Apparatus according to claim 25, wherein the said positions selected to be related in timing are substantially coincident in timing with the said selected positions along the first sampled signal.

27. Apparatus according to claim 16, wherein the said at least one acoustic feature of the first sampled signal is pitch, the said at least one acoustic feature of the second sampled signal is pitch, the said means for applying the feature modification data includes means for using the time alignment data to produce from the second sampled signal a time-aligned second signal and applying the feature modification data to the time-aligned second signal to produce a pitch modified time-aligned second signal.

28. Apparatus according to claim 27, wherein the means for applying the feature modification data includes means for modulating the feature modification data in accordance with a predetermined function so as to modify pitch in the said selected portions of the second signal jointly by the feature modification data and the predetermined function.

29. Apparatus according to claim 28, wherein the predetermined function is a function of the values of the ratio of pitch measurement in the first sampled signal to corresponding pitch measurement in the second sampled signal along the second sampled signal.

30. Audio signal modification apparatus comprising:

a time alignment module arranged to receive a new signal and a guide audio signal and to produce therefrom a time-aligned new signal;

a first pitch measurement module coupled to the time alignment module and arranged to measure pitch in the time-aligned new signal;

a second pitch measurement module arranged to receive the guide audio signal and to measure pitch in the guide audio signal;

a pitch adjustment calculator coupled to the first and second pitch measurement modules and arranged to calculate a pitch correction factor; and a pitch modulator coupled to the time alignment module to receive the time-aligned new signal and to the pitch adjustment calculator to receive the pitch correction factor and arranged to modify pitch in the time-aligned new signal in accordance with the pitch correction factor.

31. Audio signal modification apparatus comprising:

a time alignment module arranged to receive a new audio signal and a guide audio signal and to produce therefrom a time-aligned new signal;

a first acoustic feature measurement module arranged to receive the guide audio signal and to measure at least one acoustic feature of the guide audio signal;

an acoustic feature adjustment calculator coupled to the first acoustic feature measurement module and arranged to calculated an acoustic feature modification factor; and an acoustic feature modulator coupled to the time alignment module to receive the time-aligned new signal and to the acoustic feature adjustment calculator to receive the acoustic feature modification factor and arranged to modify the said at least one acoustic feature of the time-aligned new signal in accordance with the acoustic feature modification factor.

32. Audio signal modification apparatus according to claim 31, wherein a processing function module is coupled to the feature adjustment calculator to supply thereto a signal function, and the feature adjustment calculator is adapted to calculate the acoustic feature modification factor in dependence upon the signal function.

33. Audio signal modification apparatus according to claim 31, wherein a second acoustic feature measurement module is coupled to the time alignment module and arranged to measure at least one acoustic feature of the time-aligned new signal; and the acoustic feature adjustment calculator is coupled to the second acoustic feature measurement module.

34. Audio signal modification apparatus according to claim 31, wherein a second acoustic feature measurement module is arranged to receive the new audio signal and to measure the said at least one acoustic feature of the new audio signal, and wherein the acoustic feature adjustment calculator is coupled to the second acoustic feature measurement module and to the time alignment module and is adapted to align the measured acoustic features of the new audio signal to the measured acoustic features of the guide audio signal.

35. Audio signal modification apparatus comprising:

a time alignment module arranged to receive a new audio signal and a guide audio signal and to produce therefrom time alignment data;

a first acoustic feature measurement module arranged to receive the guide audio signal and to measure at least one acoustic feature of the guide audio signal;

an acoustic feature adjustment calculator coupled to the time alignment module and to the first acoustic feature measurement module and arranged to calculate time-aligned values of an acoustic feature modification factor; and an acoustic feature modulator coupled to receive the new audio signal and to the acoustic feature adjustment calculator to receive the time-aligned values of the acoustic feature modifications factor and arranged to modify the said at least one acoustic feature of the new audio signal in accordance with the time-aligned values of the acoustic feature modification factor so as to produce a modified new audio signal.

36. Audio signal modification apparatus according to claim 35, wherein a time aligner is coupled to the acoustic feature modulator to receive the modified new audio signal and to the time alignment module to receive the time alignment data and is arranged to produce a time-aligned modified new signal in accordance with the said modified new audio signal and the time alignment data.

37. Audio signal modification apparatus according to claim 35, wherein a second acoustic feature measurement module is arranged to receive the new audio signal to measure at least one acoustic feature of the new audio signal; and the acoustic feature adjustment calculator is coupled to the second acoustic feature measurement module.

38. A method according to claim 1 further comprising the step of processing the modified second signal to produce data representing a modified second signal.

39. A method according to claim 38, further comprising the step of supplying the data representing the modified second signal to a telecommunications apparatus.

40. A method according to claim 39, wherein the said supplying step includes transmitting the data representing the modified second signal through a ringtone delivery system.

41. Apparatus according to claim 16, wherein the said comparing means, the said measuring means, the said processing means, and the said applying means are part of a telecommunications apparatus.

42. Apparatus according to claim 41, wherein the telecommunications apparatus comprises a server computer coupled to a telecommunications network.

43. Apparatus according to claim 41, wherein the telecommunications apparatus comprises a mobile phone.

44. Apparatus according to claim 41, wherein the telecommunications apparatus supplies data representing a modified second signal to a ringtone delivery system.

45. Apparatus according to claim 43, wherein the mobile phone supplies data representing a modified second signal to a ringtone delivery system.

46. A method according to claim 2, wherein the said step of applying the feature modification data includes the steps of using the time alignment data to produce from the second sampled signal a time-aligned second signal and applying the feature modification data to the time-aligned second signal.

47. A method according to claim 3, wherein the said processing step includes the step of using the time alignment data with the first signal feature measurements to produce the feature modification data in time alignment with the second signal feature measurements.

48. Apparatus according to claim 16, wherein the said means for applying the feature modification data includes means for using the time alignment data to produce from the second sampled signal a time-aligned second signal and applying the feature modification data to the time-aligned second signal.

49. Apparatus according to claim 17, wherein the said processing means includes means for using the time alignment data with the first signal feature measurements to produce the feature modification data in time alignment with the second signal feature measurements.

50. Audio signal modification apparatus according to claim 32, wherein a second acoustic feature measurement module is coupled to the time alignment module and arranged to measure at least one acoustic feature of the time-aligned new signal; and the acoustic feature adjustment calculator is, coupled to the second acoustic feature measurement module.

51. Audio signal modification apparatus according to claim 36, wherein a second acoustic feature measurement module is arranged to receive the new audio signal and to measure at least one acoustic feature of the new audio signal; and the acoustic feature adjustment calculator is coupled to the second acoustic feature measurement module.

* * * * *